US008448937B2

(12) United States Patent
Okano et al.

(10) Patent No.: US 8,448,937 B2
(45) Date of Patent: May 28, 2013

(54) MEDIUM SUPPLYING APPARATUS

(75) Inventors: Shigeharu Okano, Ishikawa (JP); Nobuhisa Yamazaki, Ishikawa (JP)

(73) Assignee: PFU Limited, Ishikawa (JP)

( * ) Notice: Subject to any disclaimer, the term of this patent is extended or adjusted under 35 U.S.C. 154(b) by 1 day.

(21) Appl. No.: 13/096,525

(22) Filed: Apr. 28, 2011

(65) Prior Publication Data

US 2011/0309568 A1 Dec. 22, 2011

(30) Foreign Application Priority Data

Jun. 22, 2010 (JP) ..... 2010-141978

(51) Int. Cl.
*B65H 3/52* (2006.01)

(52) U.S. Cl.
USPC ..... 271/124; 271/110; 250/559.01

(58) Field of Classification Search
USPC ..... 271/110, 111, 124; 250/227.8, 559.01
See application file for complete search history.

(56) References Cited

U.S. PATENT DOCUMENTS

| | | | | |
|---|---|---|---|---|
| 4,319,847 | A * | 3/1982 | Howarth | 356/431 |
| 5,109,236 | A * | 4/1992 | Watanabe et al. | 347/193 |
| 5,764,251 | A * | 6/1998 | Hashimoto | 347/16 |
| 5,925,889 | A * | 7/1999 | Guillory et al. | 250/559.16 |
| 6,794,669 | B2 * | 9/2004 | Chelvayohan et al. | 250/559.4 |
| 6,998,628 | B2 * | 2/2006 | Chelvayohan | 250/559.01 |
| 7,113,313 | B2 * | 9/2006 | Tham | 358/474 |
| 7,582,888 | B2 * | 9/2009 | Shinno et al. | 250/559.4 |
| 7,741,629 | B2 * | 6/2010 | Schwarz et al. | 250/559.01 |
| 7,806,401 | B2 * | 10/2010 | Fukao | 271/124 |
| 7,969,565 | B2 * | 6/2011 | Stober | 356/237.2 |
| 2007/0114712 | A1 * | 5/2007 | Tsuchiyama et al. | 271/124 |

FOREIGN PATENT DOCUMENTS

JP 02-138805 5/1990

* cited by examiner

*Primary Examiner* — Kaitlin Joerger
(74) *Attorney, Agent, or Firm* — McDermott Will & Emery LLP

(57) ABSTRACT

A medium supplying apparatus includes a separation mechanism that separates one medium at a time from a plurality of sheet-shaped media stacked in a loading rack and transports the medium, an irradiation unit that emits light onto a surface of the medium, and a light receiving unit that receives reflected light that is acquired by allowing the light emitted by the irradiation unit to be reflected from the surface and detects a reflected light intensity that is an intensity of the reflected light. The separating force of the separation mechanism that is used for separating a next medium is controlled based on the reflected light intensity detected by the light receiving unit.

10 Claims, 13 Drawing Sheets

FIG.13

| PAPER TYPE | $\eta$ a (A1 TO A5) | $\eta$ b (B1 TO B5) | $\eta$ a/ $\eta$ b (E1 TO E5) | INTERMEDIATE GLOSS LEVEL CORRECTION δ | SEPARATION FORCE LEVEL (1 TO 5) |
|---|---|---|---|---|---|
| GLOSS-TYPE COATED PAPER (HIGH GLOSS) | A1 | B1 | E5 | LOW | 2 |
| WOODFREE PAPER (INTERMEDIATE AND LOW GLOSS) | A4 | B4 | E2 | LOW | 3 |
| USUMOZO PAPER (INTERMEDIATE GLOSS) | A3 | B3 | E3 | HIGH | 4 |
| CARBON-LESS PAPER NCR (LOW GLOSS) | A5 | B5 | E1 | LOW | 5 |
| MATT-TYPE INKJET PAPER (LOW GLOSS) | A5 | B5 | E1 | LOW | 5 |

SUBSCRIPT NUMBER IN TABLE REPRESENTS
1 (LOW)→3 (INTERMEDIATE)→5 (HIGH).

FIG.14

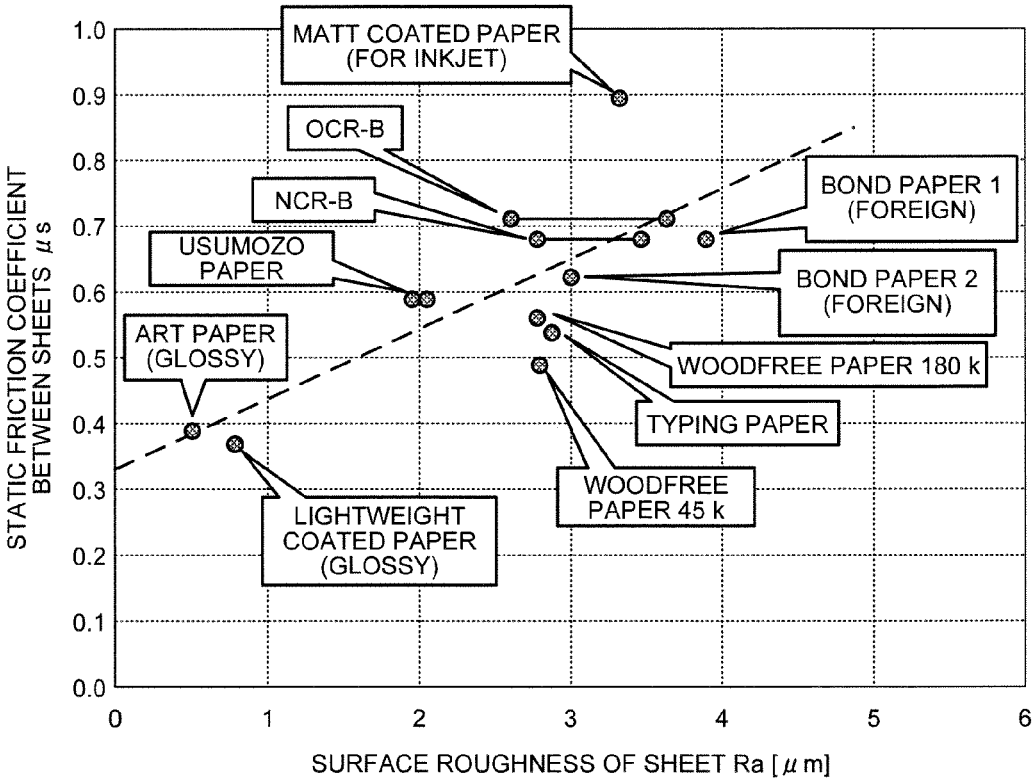

MEDIUM SUPPLYING APPARATUS

CROSS-REFERENCE TO RELATED APPLICATIONS

This application is based upon and claims the benefit of priority from Japanese Patent Application No. 2010-141978, filed on Jun. 22, 2010, the entire contents of which are incorporated herein by reference.

BACKGROUND OF THE INVENTION

1. Field of the Invention

The present invention relates to a medium supplying apparatus.

2. Description of the Related Art

Medium supplying apparatuses are apparatuses that separate and supply one medium at a time from a plurality of stacked sheet-shaped media, and these are applied to an automatic feed mechanism that is mounted in an image forming apparatus such as a printer, an image scanning apparatus such as a scanner, or the like. In the medium supplying apparatuses, it is necessary to separate and transport one after another, preventing double feeding.

Conventionally, in regard with recording apparatuses such as a printer, there is known a technology for measuring the smoothness of a recording medium and changing recording conditions based on the result of the measurement to improve the recording quality. Specifically, Japanese Patent Application Laid-open No. H02-138805 discloses a technology relating to a smoothness measuring device that determines the smoothness of a measuring surface based on the detection result from a detection unit that detects reflected light reflected from the measuring surface.

A separating force used for separating one medium from a stacked media group changes largely depending on the degree of difficulty in separating the medium. In order to appropriately separate and transport the medium, it is desirable to appropriately adjust the separating force for the medium in accordance with the degree of difficulty in separating the medium.

The object of the invention is to provide a medium supplying apparatus capable of appropriately setting the separating force used for separating one medium from a stacked media group.

SUMMARY OF THE INVENTION

It is an object of the present invention to at least partially solve the problems in the conventional technology.

According to an aspect of the present invention, a medium supplying apparatus includes: a separation mechanism that separates one medium at a time from a plurality of sheet-shaped media stacked in a loading rack and transports the medium; an irradiation unit that emits light onto a surface of the medium; and a light receiving unit that receives reflected light that is acquired by allowing the light emitted by the irradiation unit to be reflected from the surface and detects a reflected light intensity that is an intensity of the reflected light. A separating force of the separation mechanism that is used for separating a next medium is controlled based on the reflected light intensity detected by the light receiving unit.

The above and other objects, features, advantages and technical and industrial significance of this invention will be better understood by reading the following detailed description of presently preferred embodiments of the invention, when considered in connection with the accompanying drawings.

BRIEF DESCRIPTION OF THE DRAWINGS

FIG. 13 is a diagram illustrating the control of a separating force according to an embodiment;

FIG. 14 is a diagram illustrating the relationship between the surface roughness and the static friction coefficient of a sheet;

DETAILED DESCRIPTION OF THE PREFERRED EMBODIMENTS

Hereinafter, a medium supplying apparatus according to embodiments of the invention will be described with reference to the accompanying drawings. However, the invention is not limited to the embodiments. Constituent elements of each embodiment described below include elements that can be easily proposed by those skilled in the art or the substantially same elements.

First Embodiment

Figure 1:
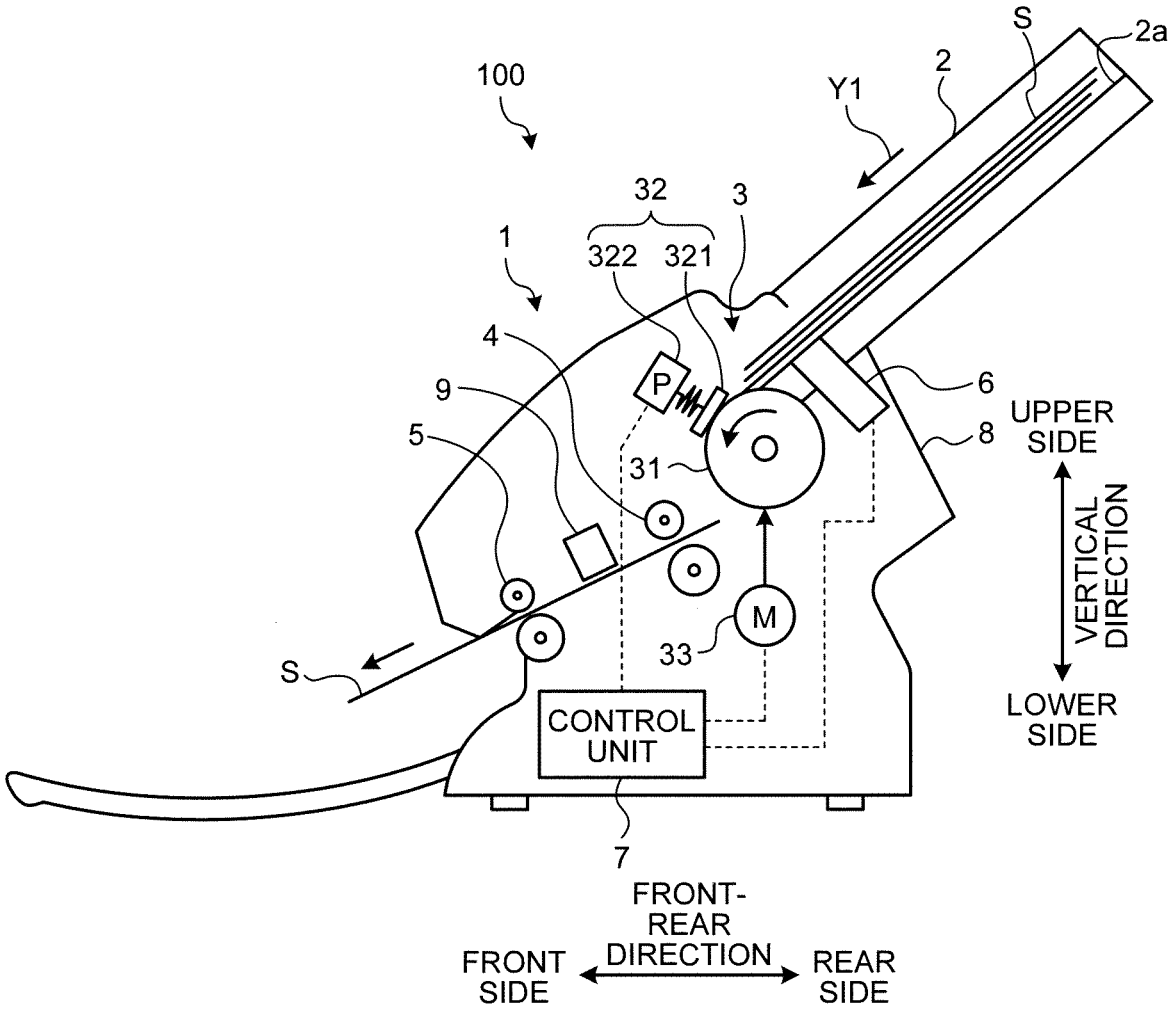
FIG. 1 is a cross-sectional view illustrating an image scanner including a medium supplying apparatus according to a first embodiment.
Figure 2:
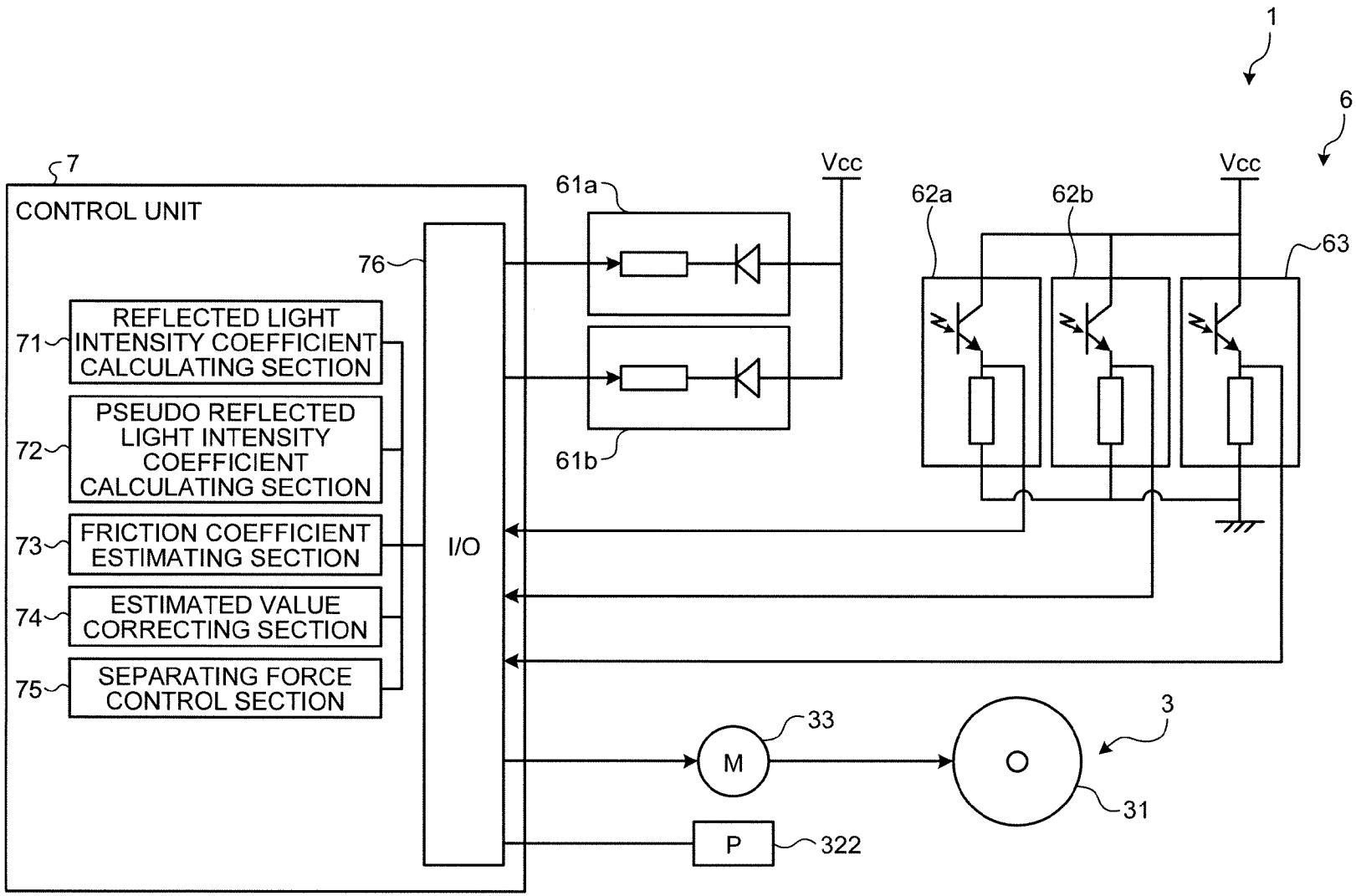
FIG. 2 is a block diagram illustrating a medium supplying apparatus according to an embodiment.
Figure 3:
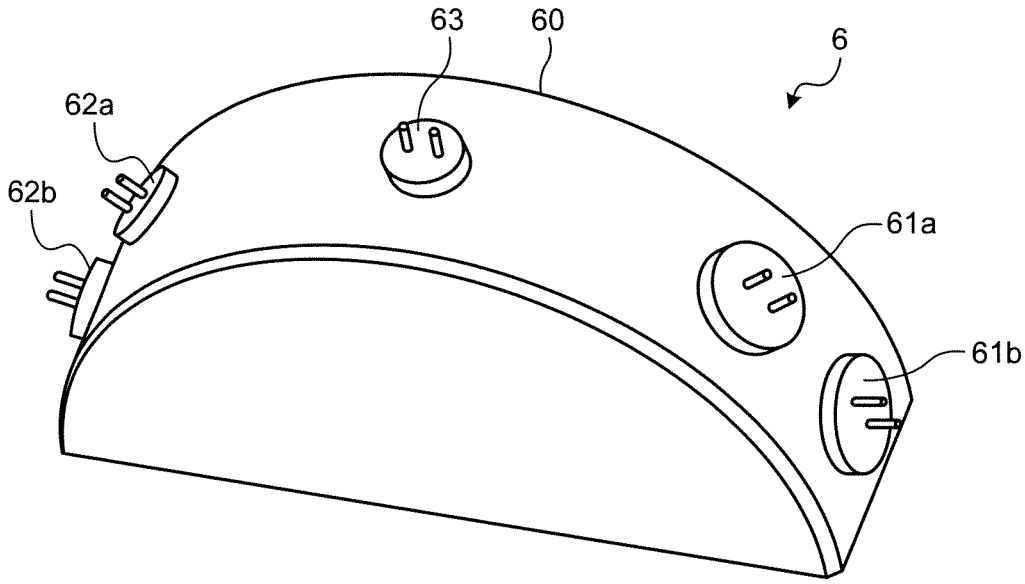
FIG. 3 is a perspective view illustrating a measurement unit of a medium supplying apparatus according to an embodiment.
Figure 4:
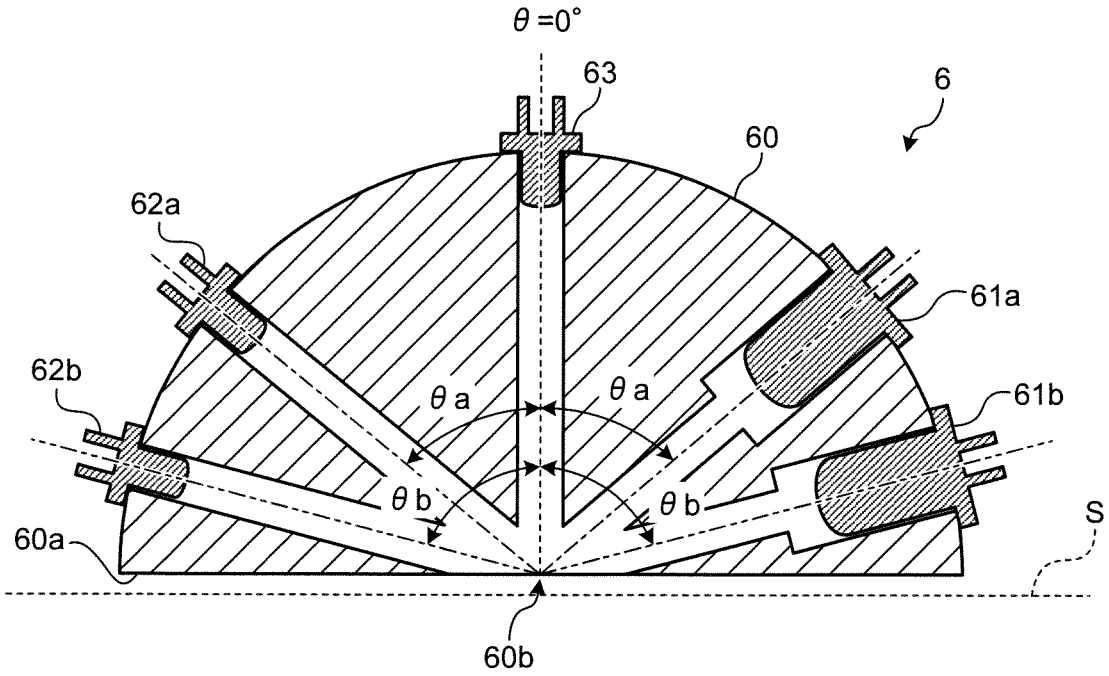
FIG. 4 is a cross-sectional view illustrating a measurement unit.
Figure 5:
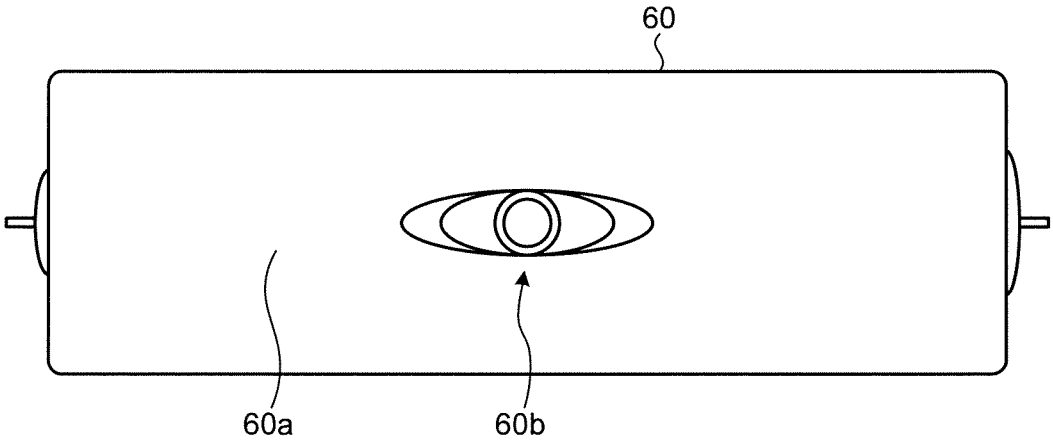
FIG. 5 is a diagram illustrating a plane portion of a measurement unit.

A first embodiment will be described with reference to FIGS. 1 to 16. This embodiment relates to a medium supplying apparatus. FIG. 1 is a cross-sectional view of an image scanner including a medium supplying apparatus according to the first embodiment. FIG. 2 is a block diagram of a medium supplying apparatus according to an embodiment. FIG. 3 is a perspective view illustrating a measurement unit of a medium supplying apparatus according to an embodiment. FIG. 4 is a cross-sectional view illustrating the measurement unit. FIG. 5 is a diagram illustrating a plane portion of the measurement unit.

A medium supplying apparatus 1 illustrated in FIG. 1 is an apparatus that separates and supplies one sheet from a plurality of stacked sheet-shaped media S each time. The medium supplying apparatus 1 is applied to an automatic feeding mechanism that is mounted in an image forming apparatus such as a printer or an image scanning apparatus such as a scanner or a facsimile, or the like. In this embodiment, a case will be described as an example in which the medium supplying apparatus 1 is mounted in an image scanner 100, and a sheet-shaped medium S is separated and transported. Here, the sheet-shaped medium includes a sheet-shaped scanning target such as a document or a name card, or a sheet-shaped recording medium such as a printing paper. In the description presented below, a sheet-shaped medium S may be briefly referred to as a "sheet."

The medium supplying apparatus 1 includes a tray 2 and a separation mechanism 3. The tray 2 is a medium loading rack that houses a plurality of stacked sheets S. The tray 2 has a loading face 2*a* that faces up. The loading face 2*a* of the tray 2 is sloped up toward the rear side. On the loading face 2*a*, a plurality of sheets S are loaded in a stacked state. The separation mechanism 3 is arranged on the downstream side of the loading face 2*a* in the transport direction Y1. The separation mechanism 3 is a mechanism that separates and transports one sheet S each time from the plurality of sheets S staked on the loading face 2*a*. The sheet S, which is separated and transported by the separation mechanism 3, is transported in the transport direction Y1 by a transport roller 4 and a discharge roller 5. The transport roller 4 is arranged on the downstream side of the separation mechanism 3 in the transport direction Y1. In addition, the discharge roller 5 is arranged on the downstream side of the transport roller 4 in the transport direction Y1.

The sheet S, which is separated by the separation mechanism 3 and is discharged from the tray 2, is transported by the transport roller 4 in the transport direction Y1. An imaging unit 9 is arranged between the transport roller 4 and the discharge roller 5 in the transport direction Y1. The imaging unit 9 generates image data by imaging the transported sheet S. The sheet S with image data generated by the imaging unit 9 is discharged by the discharge roller 5 outside the image scanner 100. When one sheet S is discharged from the tray 2, the separation mechanism 3 temporarily stops before the starting of feeding of the following sheet S. For example, the feeding of the following sheet S is started after the completion of the imaging of the preceding sheet S. The transport control of a sheet S is performed, for example, based on the detection result of a sensor that detects the presence of a sheet S on the transport path of the sheet S. As the sheets S stacked on the tray 2 are sequentially separated and transported one after another by the medium supplying apparatus 1 and are imaged by the imaging unit 9, image scanning for the plurality of sheets S is continuously performed.

The separation mechanism 3 is used for separating and transporting one sheet each time to discharge the sheet S from the tray without double feeding. In regard with a method of separating and transporting the sheet, there are known many methods, for example, including a frictional separation plate method, a reverse roller method, a reverse belt method, a retard roller method, a gate roller method, and the like. Here, as an example, the configuration of the separation mechanism 3 using the frictional separation plate method will be described.

The separation mechanism 3 includes a pick roller 31, a separation unit 32, and a driving unit 33. The pick roller 31 is a roller that is brought into frictional contact with a sheet S placed inside the tray 2 and rotates with the sheet S so as to discharge the sheet S in the transport direction. In other words, the pick roller 31 discharges a transport target medium by rotating in a state of being in contact with the transport target sheet S to be separated next time by the separation mechanism 3 from the plurality of stacked sheets S. The pick roller 31 is formed in a cylindrical shape from a material having a strong frictional force such as a foamed rubber.

The pick roller 31 is arranged at an end portion of the loading face 2*a* on the downstream side in the transport direction, that is, at an end portion of the loading face 2*a*, which is positioned on the transport roller 4 side. The center shaft of the pick roller 31 is located below the loading face 2*a*, that is, it is located on the side opposite to the loading face 2*a* on which the sheets S are loaded. The center shaft of the pick roller 31 extends in the widthwise direction of the loading face 2*a*. The pick roller 31 is arranged such that the outer circumferential face thereof is positioned on an extended plane of the loading face 2*a*. In this embodiment, the outer circumferential face of the pick roller 31 slightly protrudes toward the loading face 2*a* on which the sheets S are loaded. Accordingly, the lower face of the lowest sheet S out of the plurality of sheets stacked on the loading face 2*a* is brought into contact with the circumferential face of the pick roller 31. The lower face faces the sheet loading face 2*a*.

The separation unit 32 includes a separation pad 321 and a pressing force control section 322. The separation pad 321 is brought into frictional contact with a sheet S and applies a force, to the sheet S, which suppresses the movement of the sheet S in the transport direction. The separation pad 321 is a separation member that prevents multiple sheets S from being fed by being brought into frictional contact with a sheet S that is to be potentially discharged along with the transport target sheet S in an overlapping state, thereby to separate the sheet S from the transport target sheet S. The separation pad 321, for example, is formed of a plate-shape member made of rubber and can apply a frictional force, which is stronger than the frictional force between adjacent sheets, to a sheet S when being brought into contact with the sheet S.

The separation pad 321 is arranged on a side opposite to the pick roller 31 side with the extended plane of the loading face 2*a* interposed therebetween and faces the outer circumferential face of the pick roller 31 in the direction of the normal line that is perpendicular to the loading face 2*a*. The separation pad 321 is pressed toward the outer circumferential face of the pick roller 31 by the pressing force control section 322. Accordingly, when the pick roller 31 does not transport a sheet, the separation pad 321 is in the state of being brought into contact with the outer circumferential face of the pick roller 31. The pressing force control section 322 is a mechanism that presses the separation pad 321 toward the pick roller 31 and, for example, includes a spring mechanism. The pressing force control section 322 controls the pressing force of the separation pad 321 with respect to a sheet S by controlling the biasing force of the spring mechanism that biases the separation pad 321 toward the pick roller 31. The driving of the pressing force control section 322 is controlled by a control unit 7.

The driving unit 33 is an actuator that drives the pick roller 31 and includes a motor and a deceleration mechanism. The motor is connected to the pick roller 31 through the deceleration mechanism. When the motor rotates, the rotation of the motor is decelerated by the deceleration mechanism and is transferred to the pick roller 31, and accordingly, the pick roller 31 is driven to rotate. The rotation direction of the pick roller 31 that is driven to rotate by the motor is a direction in which the outer circumferential face thereof is brought into contact with the sheet S face from the upstream side toward the downstream side in the transport direction. In other words, the sheet S that is brought into contact with the rotating pick roller 31 receives a force toward the downstream side in the transport direction from the outer circumferential face of the pick roller 31. The sheet S that is fed in the transport direction by the pick roller 31 passes through between the pick roller 31 and the separation pad 321 and is discharged toward the transport roller 4. The medium supplying apparatus 1 is a lower-side extraction supplying type in which a sheet S is sequentially discharged from the lowest layer of the plurality of sheets S housed in the tray 2.

Here, when the driving unit 33 drives the pick roller 31 so as to rotate, there are cases where not only the lowest sheet S that is sent by being brought into contact with the pick roller 31 but also another sheet S is sent due to a frictional force between the sheets S or the like in the state of overlapping the lowest sheet S. In this embodiment, a sheet S that is sent by being brought into contact with the pick roller 31 is referred to as a transport target sheet, and a sheet S that is sent along with the transport target sheet in an overlapping state without being brought into contact with the pick roller 31 is referred to as a separation target sheet.

When passing through between the pick roller 31 and the separation pad 321, the separation target sheet is brought into frictional contact with the separation pad 321. At this time, since the frictional force between the separation pad 321 and the separation target sheet is stronger than the frictional force between the sheets, the separation target sheet is separated from the transport target sheet. The capability of the separation mechanism 3 in separating a sheet, that is, the separation strength is determined dominantly based on a balance between a transport load that tends to stop the sheet S and the pressing force that is used for pressing the separation unit against the sheet S. Here, the transport load, for example, includes the frictional force or the friction coefficient of the separation pad 321. In this embodiment, as will be described below, the separation pad 321 is pressed toward the pick roller 31 with an appropriate pressing force corresponding to the degree of difficulty in separating the sheet S stacked in the tray 2. Accordingly, only the transport target sheet S passes through between the pick roller 31 and the separation pad 321, and thus the feeding of multiple sheets S is prevented.

Here, the separating force that is appropriate for separating one sheet S from a group of stacked sheets S changes in accordance with the degree of difficulty in separating the sheet S. The separating force for the sheet S is determined based on a physical quantity that is used for determining the operation, the state, and the like of the separation mechanism 3 when one sheet S is separated from the other sheets S. In this embodiment, as the separating force, the pressing force that is used for pressing the separation pad 321 toward the pick roller 31 by the pressing force control section 322. The degree of difficulty in separating the sheet S relates to the friction coefficient of the sheet, and more particularly to the static friction coefficient. Accordingly, in order for the separation mechanism 3 to appropriately perform the separating and the transporting of the sheet, it is preferable that the separating force corresponding to the static friction coefficient of the sheet S can be set for the sheet S.

Although the separating force may be set in advance in accordance with a sheet S in a case where the type of the sheet S stacked in the tray 2 is specified in advance, various types of sheets S can be used, for example, in a case where the medium supplying apparatus 1 is mounted in the image scanner 100. In other words, it cannot be known in advance which type of sheets S is stacked in the tray 2. Furthermore, there is a case where a sheet S that has a different degree of difficulty in separation is mixed in the group of stacked sheets S. In order to appropriately perform the separation and the transportation of the sheet S by suppressing the feed of multiple sheets, it is preferable that the degree of difficulty in separating the sheets stacked in the tray 2, and, more particularly, the degree of difficulty in separating the lowest sheet, which is to be separated and transported next, is reflected on the separating force for the sheet S.

In the medium supplying apparatus 1 according to this embodiment, the separating force of the separation mechanism 3 is set in accordance with the degree of difficulty in separating the sheet S stacked in the tray 2. Described in more detail, as will be described below, the separating force is determined based on the intensity of reflected light reflected from the surface of a sheet S that is to be separated next by the separation mechanism 3. Accordingly, the sheets S can be separated and transported one sheet at a time with a separating force according to the sheet S.

The friction coefficient of the sheet S is a physical interface phenomenon based on the surface properties of the sheet S including the surface roughness and the surface strength of the sheet S and the material thereof and is understood to be strongly dependent particularly on the surface roughness of the sheet S. In addition, as will be described below, there is the relationship between the surface properties and the states of a sheet S and the reflection characteristics of light on the surface of the sheet S.

Figure 15:
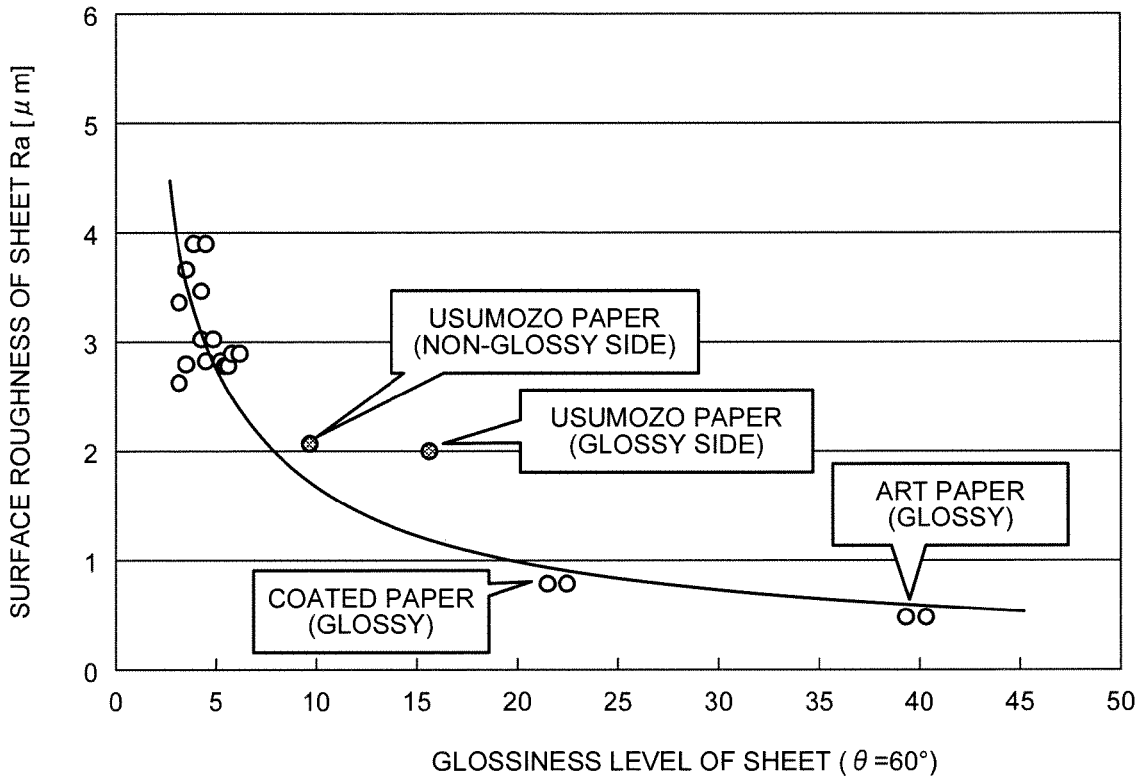
FIG. 15 is a diagram illustrating the relationship between the glossiness of a sheet and the surface roughness of a sheet.
Figure 16:
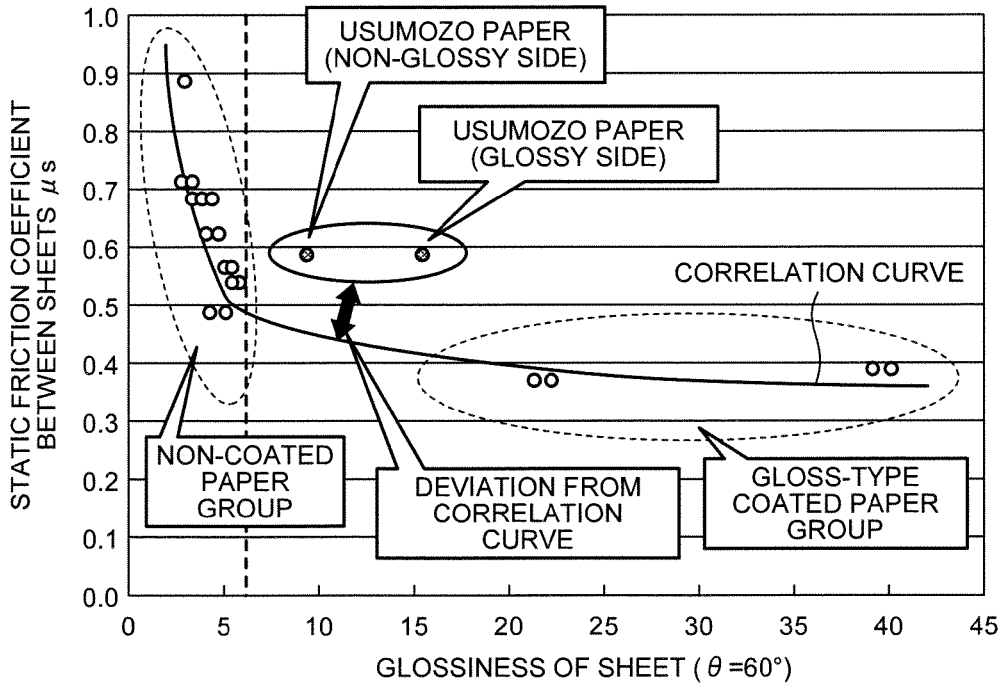
FIG. 16 is a diagram illustrating the relationship between the glossiness of a sheet and the static friction coefficient of a sheet.

FIG. 14 is a diagram illustrating the relationship between the surface roughness Ra of sheets S and the static friction coefficient μs of the sheets S. FIG. 15 is a diagram illustrating the relationship between the glossiness of a sheet S and the surface roughness Ra of the sheet S. FIG. 16 is a diagram illustrating the relationship between the glossiness of sheets S and the static friction coefficient μs between the sheets S. Here, the static friction coefficient between sheets S represents a static friction coefficient between sheets S that are in contact with each other when the sheets S of the same type are stacked. As illustrated in FIGS. 14 to 16, there is a predetermined correlation among the surface roughness Ra of the sheet, the static friction coefficient μs between the sheets S of the same type, and the glossiness of the sheet S. For example, as illustrated in FIG. 16, there is the relationship that the static friction coefficient μs between sheets in a group of gloss-type coated papers having a relatively high glossiness of the sheets S is less than the static friction coefficient μs between sheets S in a group of non-coated papers having a relatively low glossiness of the sheets S.

Accordingly, in a case where the separating force of the separation mechanism 3 is controlled in accordance with the glossiness of the sheet S stacked in the tray 2, the separation of the sheet S can be more appropriately performed than a case where the separating force of the separation mechanism 3 is uniform. In this embodiment, the separating force for the sheet S is set based on the intensity of reflected light, which relates to the glossiness and the degree of smoothness of the sheet, reflected from the surface of the sheet S. As illustrated in FIG. 1, the medium supplying apparatus 1 includes a measurement unit 6 that measures the intensity of the reflected light of the sheet S and the control unit 7 that controls the separating force of the separation mechanism 3 for the sheet S based on the measured intensity of the reflected light.

The measurement unit 6 irradiates the lowest sheet S that is to be separated next with light and measures a specularly-reflected light component and a diffusely-reflected light component of the reflected light reflected from the sheet S. As illustrated in FIG. 1, the measurement unit 6 is arranged at a downstream position of the tray 2 in the transport direction. The end portion of the tray 2 that is located on the downstream side in the transport direction is disposed inside a casing 8 of the image scanner 100. The measurement unit 6 is arranged in a portion of the tray 2 that is located inside the casing 8. The measurement unit 6 is fixed to a plate-shaped member having the loading face 2*a*.

As illustrated in FIGS. 3 and 4, a main body 60 of the measurement unit 6 has a half-cylinder shape. In other words, the main body 60 has a shape acquired by cutting a cylinder into two in the plane including the center axial line. The main body 60, for example, is fixed to the tray 2 such that a plane portion 60*a* corresponding to the cut surface is located on the same plane as that of the loading face 2*a* of the tray 2, and the arc portion of the main body 60 protrudes from this plane toward the side opposite to the sheet S side. In other words, the plane portion 60*a* of the measurement unit 6 is located at a position near the lower face of the sheet S that is to be separated next and faces the lower face. In this embodiment, the main body 60 is fixed to the tray 2 such that the axial direction thereof coincides with the transport direction. However, the shape of the main body 60 and the fixed position thereof with respect to the tray 2 are not limited thereto.

As illustrated in FIG. 4, the measurement unit 6 includes a first irradiation section 61*a*, a second irradiation section 61*b*, a first specularly-reflected light receiving section 62*a*, a second specularly-reflected light receiving section 62*b*, and a diffusely-reflected light receiving section 63 that are radially arranged with respect to the center axial line of the main body 60. The irradiation sections 61*a* and 61*b*, the specularly-reflected light receiving sections 62*a* and 62*b*, and the diffusely-reflected light receiving section 63 are disposed at the same position in the axial direction of the main body 60. In other words, the optical axes of the irradiation sections 61*a* and 61*b*, the optical axes of the specularly-reflected light receiving sections 62*a* and 62*b*, and the optical axis of the diffusely-reflected light receiving section 63 are on the same plane, and the plane is orthogonal to the axial direction of the main body 60.

The first irradiation section 61*a* and the second irradiation section 61*b* emit light onto the surface of the sheet S and, for example, may be configured by light emitting diodes (LEDs). Each of the irradiation sections 61*a* and 61*b* may emit light having a peak wavelength in an infrared band or light having a peak wavelength in another band such as a visible light region. In a case where the irradiation sections 61*a* and 61*b* emit light having a wavelength peak in the infrared band, the effects of the color of the sheet S and the printed image, that is, the effects of a reflected light component included in the visible light band are reduced. In such a case, there is an advantage in that the measurement unit 6 can measure the intensity of the reflected light of the sheet S with high accuracy.

The first irradiation section 61*a* and the second irradiation section 61*b* emit light onto the surface of the sheet S at different incidence angles. The direction of the optical axis of the first irradiation section 61*a* and the direction of the optical axis of the second irradiation section 61*b* intersect at the center of the arc of the main body 60. In other words, the first irradiation section 61*a* and the second irradiation section 61*b* are arranged so as to emit light to a common irradiation target portion.

The tilt angle θa of the direction of the optical axis of the first irradiation section 61*a* and the tilt angle θb of the direction of the optical axis of the second irradiation section 61*b* are different from each other. Here, the tilt angle θ is an angle between the direction of the optical axis and a diameter direction orthogonal to the plane portion 60*a* when viewed in the axial direction. In other words, the tilt angle θ is the center angle of an arc that is interposed between the diameter direction that passes through the center of the arc of the main body 60 and is orthogonal to the plane portion 60*a* and the direction of the optical axis. Hereinafter, the diameter direction orthogonal to the plane portion 60*a* is referred to as a reference diameter direction. In the reference diameter direction, the tilt angle θ is zero degrees. The tilt angle θa of the first irradiation section 61*a* is less than the tilt angle θb of the second irradiation section 61*b*. Accordingly, the incidence angle θa of light emitted by the first irradiation section 61*a* with respect to the sheet S is less than the incidence angle θb of light emitted by the second irradiation section 61*b* with respect to the sheet S.

The first specularly-reflected light receiving section 62*a* and the second specularly-reflected light receiving section 62*b* are specularly-reflected light receiving sections that receive specularly-reflected light components of reflected light that is acquired by reflecting the light emitted by the first irradiation section 61*a* and the second irradiation section 61*b* from the surface of the sheet S. Each of the first specularly-reflected light receiving section 62*a* and the second specularly-reflected light receiving section 62*b* includes a sensor that detects the intensity of the reflected light that is the intensity of the specularly-reflected light component and, for example, may be configured by a photo transistor. The first specularly-reflected light receiving section 62*a* receives specularly-reflected light that is emitted by the first irradiation section 61*a* and is reflected from the surface of the sheet S. The first specularly-reflected light receiving section 62*a* is arranged at a position that is symmetrical about a line to the first irradiation section 61*a* with respect to the reference diameter direction when viewed in the axial direction. In other words, the first specularly-reflected light receiving section 62*a* is arranged on a side opposite to the first irradiation section 61*a* from the reference diameter direction, and the tilt angle of the direction of the optical axis of the first specularly-reflected light receiving section 62*a* is θa that is the same as the tilt angle of the direction of the optical axis of the first irradiation section 61*a*.

Similarly, the second specularly-reflected light receiving section 62*b* receives a specularly-reflected light component of reflected light that is emitted by the second irradiation section 61*b* and is reflected from the surface of the sheet S and detects the intensity of the specularly-reflected light. The second specularly-reflected light receiving section 62*b* is arranged at a position that is symmetrical about a line to the second irradiation section 61*b* with respect to the reference diameter direction when viewed in the axial direction. In other words, the second specularly-reflected light receiving section 62*b* is arranged on a side opposite to the second irradiation section 61*b* from the reference diameter direction, and the tilt angle of the direction of the optical axis of the second specularly-reflected light receiving section 62*b* is θb that is the same as the tilt angle of the direction of the optical axis of the second irradiation section 61*b*.

The diffusely-reflected light receiving section 63 receives a diffusely-reflected component of reflected light acquired by reflecting the light emitted onto the surface of the sheet S by the first irradiation section 61*a* and the second irradiation section 61*b* from the surface of the sheet S. The diffusely-reflected light receiving section 63 includes a sensor that detects the intensity of the diffusely-reflected light that is the intensity of the diffusely-reflected light component and, for example, may be configured by a photo transistor. The direction of the optical axis of the diffusely-reflected light receiving section 63 is set to the reference diameter direction that is the direction at a tilt angle of zero degrees.

In the main body 60, through holes that pass through the main body 60 in diameter directions along the directions of the optical axes of the irradiation sections 61*a* and 61*b* and the specularly-reflected light receiving sections 62*a* and 62*b*, and the diffusely-reflected light receiving section 63 are formed. As illustrated in FIGS. 4 and 5, the through holes communicate with one another through an opening portion 60*b* that is formed at the center of the arc. The light emitted from the irradiation sections 61*a* and 61*b* is emitted from the corresponding through holes to the sheet S through the opening portion 60*b*. In addition, the reflected light reflected from the sheet S passes through the through holes from the opening portion 60*b* and arrives at the reflected light receiving sections 62*a*, 62*b*, and 63. As above, by allowing the light emitted onto the sheet S and the light reflected from the sheet S to pass through the through holes, the detection accuracy of the intensity of the reflected light is improved.

In this embodiment, the tilt angle θa of the first irradiation section 61*a* and the first specularly-reflected light receiving section 62*a* is 50 degrees, and the tile angle θb of the second irradiation section 61*b* and the second specularly-reflected light receiving section 62*b* is 75 degrees. In addition, the tilt angle θ of the diffusely-reflected light receiving section 63 is zero degrees. However, the tilt angles θ are not limited thereto.

Figure 6:
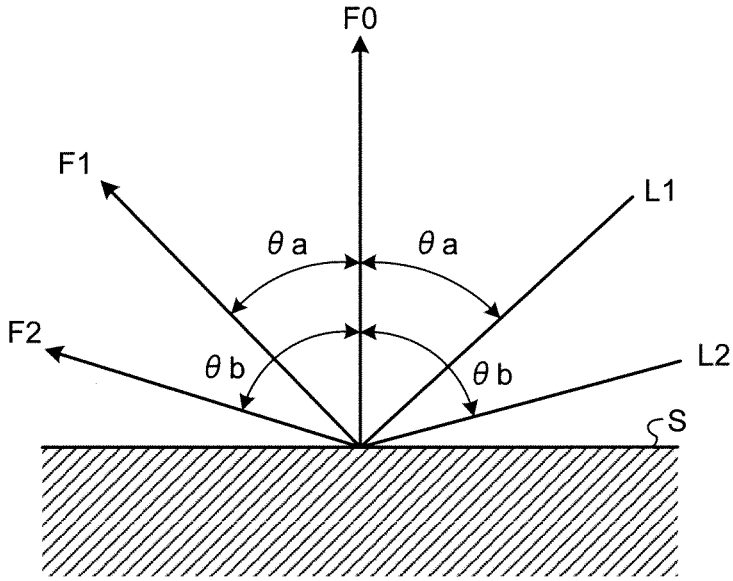
FIG. 6 is a diagram illustrating the relationship between incident light and reflected light in a measurement unit.

FIG. 6 is a diagram illustrating the relationship between incident light and reflected light for a sheet S in the measurement unit 6. The measurement unit 6 can selectively emit light to the sheet S by using the first irradiation section 61*a* or the second irradiation section 61*b*. Here, the sheet S to which the first irradiation section 61*a* and the second irradiation section 61*b* emit light is the lowest sheet, that is, a sheet S that is to be separated next by the separation mechanism 3 out of the plurality of stacked sheets S. In a case where light is emitted by using the first irradiation section 61*a*, the first irradiation section 61*a* emits light L1 at a tilt angle θa with respect to the surface of the sheet S. At this time, the second irradiation section 61*b* is not allowed to emit light. The light L1 emitted by the first irradiation section 61*a* is reflected from the surface of the sheet S. The first specularly-reflected light receiving section 62*a* receives a specularly-reflected light component out of the reflected light and outputs a signal that represents the intensity F1 of the specularly-reflected light that is the intensity of the reflected light. In addition, the diffusely-reflected light receiving section 63 receives a diffusely-reflected light component that is in the direction of the normal line of the sheet S and outputs a signal that represents the intensity F0 of the diffusely-reflected light that is the intensity of the reflected light. The light L1 emitted by the first irradiation section 61*a* corresponds to a first irradiation beam, and the tilt angle θa corresponds to a first incidence angle.

In a case where light is emitted by using the second irradiation section 61*b*, the second irradiation section 61*b* emits light L2 at a tilt angle θb with respect to the surface of the sheet S. At this time, the first irradiation section 61*a* is not allowed to emit light. The light L2 emitted by the second irradiation section 61*b* is reflected from the surface of the sheet S. The second specularly-reflected light receiving section 62*b* receives a specularly-reflected light component out of the reflected light and outputs a signal that represents the intensity F2 of the specularly-reflected light that is the intensity of the reflected light. In addition, the diffusely-reflected light receiving section 63 receives a diffusely-reflected light component that is in the direction of the normal line of the sheet S and outputs a signal that represents the intensity F0 of the diffusely-reflected light that is the intensity of the reflected light. The light L2 emitted by the second irradiation section 61*b* corresponds to a second irradiation beam, and the tilt angle θb corresponds to a second incidence angle.

The control unit 7 illustrated in FIG. 2 controls the separating force of the separation mechanism 3 for the sheet S based on the detection result of the measurement unit 6. The control unit 7, for example, includes a control device that has an electronic control unit (ECU). The control unit 7 has the functions of a reflected light intensity coefficient calculating section 71, a pseudo reflected light intensity coefficient calculating section 72, a friction coefficient estimating section 73, an estimated value correcting section 74, and a separating force control section 75. In addition, the control unit 7 transmits or receives signals to or from each device of the image scanner 100 through an input/output section 76.

The control unit 7 transmits or receives signals to or from the irradiation sections 61*a* and 61*b*, the specularly-reflected light receiving sections 62*a* and 62*b*, and the diffusely-reflected light receiving section 63 through the input/output section 76. In addition, the control unit 7 transmits or receives signals to or form the driving unit 33 and the pressing force control section 322 through the input/output section 76.

The reflected light intensity coefficient calculating section 71 calculates a reflected light intensity coefficient η based on the output signal of the measurement unit 6. The reflected light intensity coefficient η represents a ratio of a diffusely-reflected light component to a specularly-reflected light component of light that is emitted from one irradiation section to a sheet S and is reflected from the sheet S. For example, the reflected light intensity coefficient η in a case where light is emitted by the first irradiation section 61*a* is a ratio of the diffusely-reflected light intensity F0 to the specularly-reflected light intensity F1, that is, F0/F1. In the description presented below, the reflected light intensity coefficient η that is acquired in the state in which light is emitted by the first irradiation section 61*a*, and the second irradiation section 61*b* is not allowed to emit light is referred to as a first reflected light intensity coefficient ηa, and the reflected light intensity coefficient η that is acquired in the state in which light is emitted by the second irradiation section 61*b*, and the first irradiation section 61*a* is not allowed to emit light is referred to as a second reflected light intensity coefficient ηb.

The pseudo reflected light intensity coefficient calculating section 72 calculates a pseudo reflected light intensity coefficient ηs. The pseudo reflected light intensity coefficient ηs is an estimated value of the reflected light intensity coefficient η in a case where it is assumed that light is emitted onto the sheet S at a predetermined tilt angle θs. The predetermined tilt angle θs is a general tilt angle θ of light emitted for measuring the surface reflectivity of a sheet S such as the glossiness of the sheet S. For example, the predetermined tilt angle θs may be an angle in the range of 60 degrees to 70 degrees. In this embodiment, the pseudo reflected light intensity coefficient ηS in a case where light is emitted onto the sheet S at a tilt angle θs=67 degrees is estimated based on a reflected light intensity coefficient ηa for the first irradiation section 61*a* with a tilt angle θa=50 degrees and a reflected light intensity coefficient ηb for the second irradiation section 61*b* with a tilt angle θb=75 degrees. As above, the pseudo reflected light intensity coefficient ηs is calculated based on the reflected light intensity coefficients η calculated for a plurality of irradiation sections with different tilt angles θ.

Figure 7:
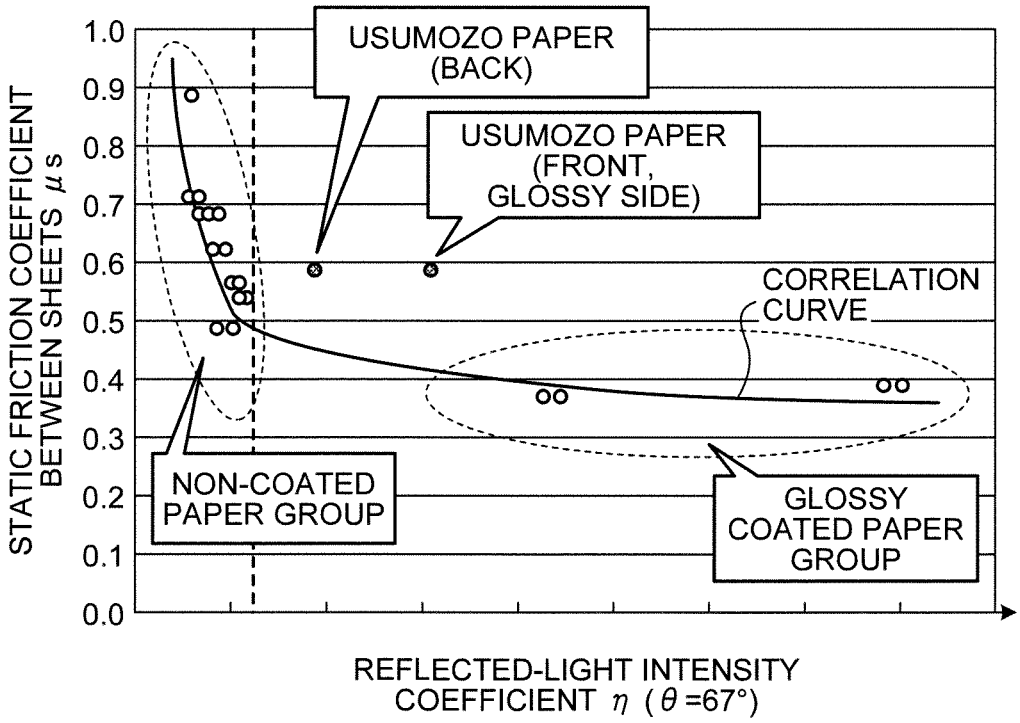
FIG. 7 is a diagram illustrating the measured value of the intensity coefficient of reflected light and the measured value of a static friction coefficient.

The friction coefficient estimating section 73 calculates the static friction coefficient of the sheet S based on the pseudo reflected light intensity coefficient ηs. FIG. 7 is a diagram illustrating a measured value of the reflected light intensity coefficient η for a tilt angle of 67 degrees and a measured value of the static friction coefficient μs. In the horizontal axis shown in FIG. 7, the reflected light intensity coefficient η decreases toward the right side in the direction of the axis. As illustrated in FIG. 7, there is a predetermined correlation between the reflected light intensity coefficient η and the static friction coefficient between sheets S. For example, in a case where a correlation curve between the reflected light intensity coefficient η and the static friction coefficient μs between sheets, as illustrated in FIG. 7, is acquired based on the measured values, the static friction coefficient can be estimated based on the correlation curve and the pseudo reflected light intensity coefficient μs. According to this embodiment, by estimating the static friction coefficient between sheets S based on the pseudo reflected light intensity coefficient ηs for a tile angle of 67 degrees, the accuracy of estimation of the static friction coefficient is improved.

Figure 8:
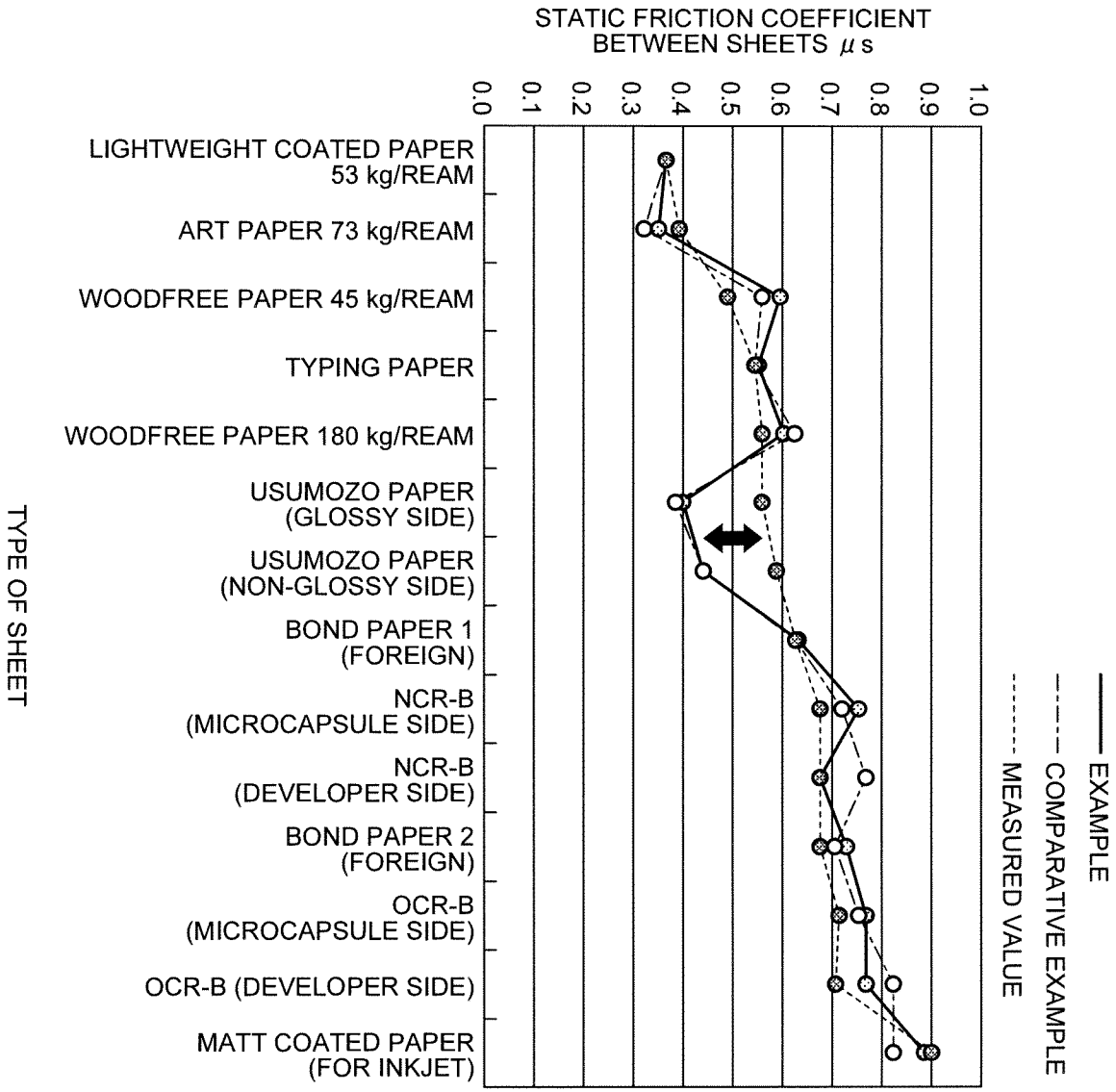
FIG. 8 is a diagram illustrating the measured value and the estimated value of a static friction coefficient.

FIG. 8 is a diagram illustrating estimation results based on measured values of the static friction coefficient between sheets S and the reflected light intensity coefficients η for various sheets S. In FIG. 8, a comparative example represents estimated values in a case where an estimated value of the static friction coefficient is calculated based on only the reflected light intensity coefficient ηa when light is emitted by the first irradiation section 61*a* with a tilt angle θa=50 degrees. In other words, an estimated result of estimating the static friction coefficient between sheets S based on a correlation curve that is acquired based on measured values of the reflected light intensity coefficient ηa with a tilt angle θa=50 degrees and measured values of the static friction coefficient between sheets S is the comparative example. In addition, an example represents estimated values of the static friction coefficient between sheets S that are estimated based on the pseudo reflected light intensity coefficient ηs with a predetermined tilt angle θs=67 degrees and the correlation curve illustrated in FIG. 7. When the estimated values of the example and the estimated values of the comparative example are compared, in the example, the accuracy of the estimated value of the static friction coefficient for a sheet S having a large static friction coefficient is improved.

The accuracy of estimation of the static friction coefficient between sheets S can be improved by estimating the static friction coefficient based on the pseudo reflected light intensity coefficient ηs as above. As illustrated in FIG. 7, in a glossy coated paper group or a non-coated paper group, the reflected light intensity coefficient η and the static friction coefficient between sheets S can be associated with each other by one correlation curve with high accuracy, and thus, particularly, the accuracy of estimation of the static friction coefficient is high. However, in an intermediate-gloss area (an intermediate-gloss area between the non-coated paper group and the glossy coated paper group), for example, like a thin non-coated smoothed paper which is called an usukuchi-mozo-shi or usumozo paper in Japan (see, for example, Nomura, Tadayoshi; "Jouzuni Tsukiau Insatsu Youshi", Nihon Insatsu Shimbunsya, 1999, p. 23), there is a specific paper having characteristics deviated from the correlation curve of the sheet S group. This usumozo paper is a non-coated paper of which the surface is supercalendered so as to be highly polished.

In the medium supplying apparatus 1 according to this embodiment, in order to appropriately acquire a static friction coefficient even for a sheet S that has a reflected light intensity characteristic deviated from the correlation curve, the estimated value of the static friction coefficient is corrected. The correction of the estimated value of the static friction coefficient is performed by the estimated value correcting section 74. The estimated value correcting section 74 corrects the estimated value of the static friction coefficient of the sheet S that is calculated by the friction coefficient estimating section 73. The estimated value correcting section 74, as is described as below with reference to FIGS. 9 to 11, corrects the estimated value of the static friction coefficient based on the ratio (ηa/ηb) between the reflected light intensity coefficients ηa and ηb for different tilt angles θa and θb. Accordingly, the static friction coefficient can be appropriately estimated even for a sheet S that has the same reflected light intensity characteristic as that of an usumozo paper.

The ratio ηa/ηb of the first reflected light intensity coefficient ηa to the second reflected light intensity coefficient ηb represents the degree of the increase in the reflected light intensity coefficient η in a case where the tilt angle θ of emitted light is changed from a large angle to a small angle. In the description presented below, ηa/ηb that is the degree of the increase in the reflected light intensity coefficient η is also referred to as an "increase rate ηa/ηb of the reflected light intensity coefficient." As the degree of the gloss of the sheet S (or glossiness of a sheet S) is higher, the increase rate ηa/ηb of the reflected light intensity coefficient tends to increase, and accordingly, the characteristics of the sheet S can be extracted in a simple manner.

Figure 9:
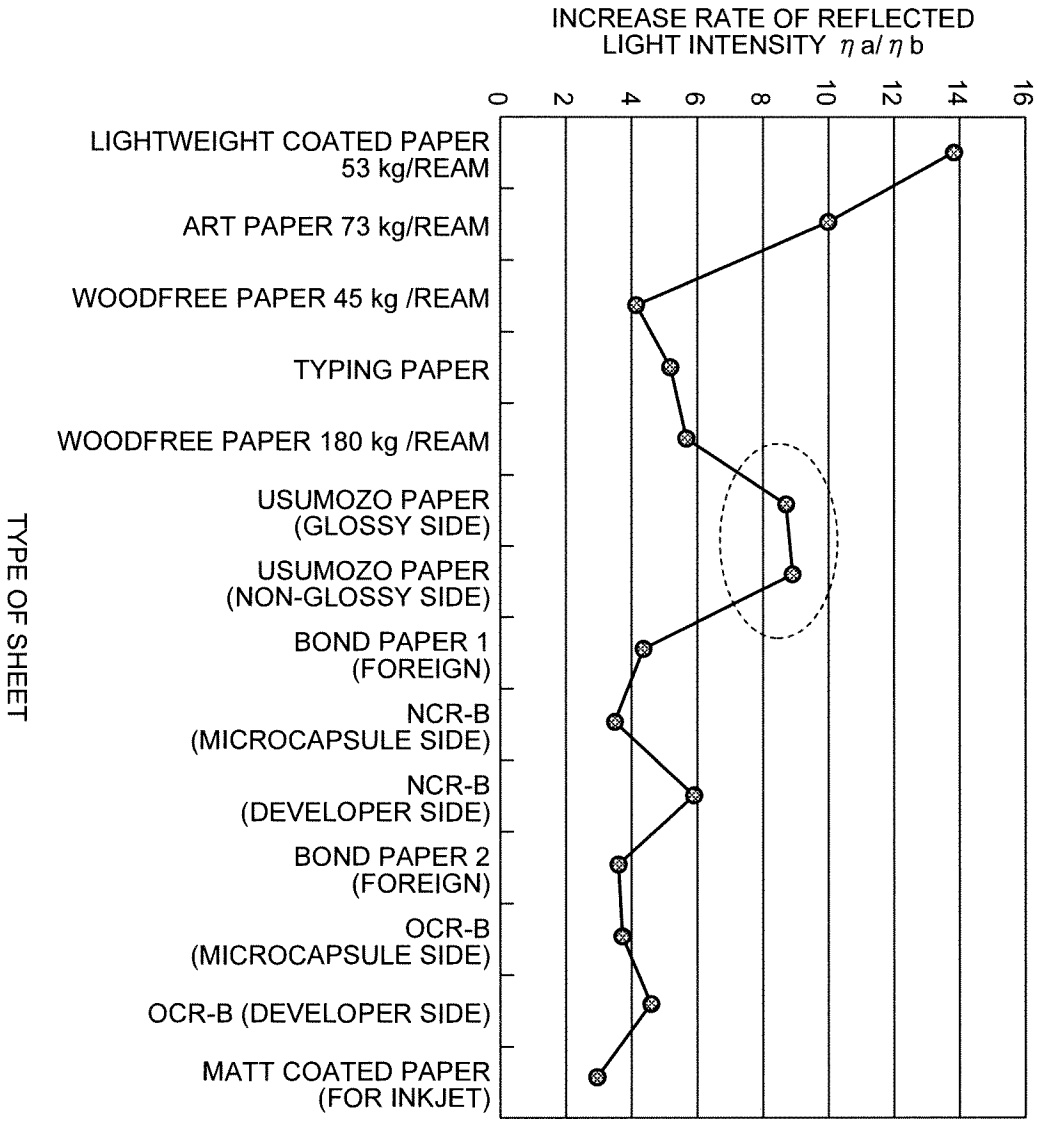
FIG. 9 is a diagram illustrating the relationship between the type of a sheet and the increase rate of the reflected light intensity coefficient.

FIG. 9 is a diagram illustrating the relationship between the type of a sheet S and the increase rate ηa/ηb of the reflected light intensity coefficient. In the horizontal axis shown in FIG. 9, the static friction coefficient of a sheet S decreases toward the left side, and the static friction coefficient of a sheet S increases toward the right side. The increase rate ηa/ηb of the reflected light intensity coefficient of a light-weight coated paper or an art paper is especially high, and as an overall trend for other types of sheets, as the static friction coefficient becomes larger, the increase rate ηa/ηb of the reflected light intensity coefficient is lowered. However, for an usumozo paper, this trend is reversed, and a high increase rate ηa/ηb of the reflected light intensity coefficient is exhibited. In other words, the usumozo paper does not have a glossiness as high as the glossy coated paper and a glossiness as low as the non-coated paper called a plain paper. In other words, the usumozo paper is in the intermediately glossy level. In this embodiment, by taking it into consideration that a sheet S such as an usumozo paper that has an intermediately glossy level represents an increase rate ηa/ηb of the reflected light intensity coefficient that is different from that of other non-coated paper groups or a gloss-type coated paper group, the static friction coefficient of the sheet S having an intermediately glossy level is corrected.

Figure 10:
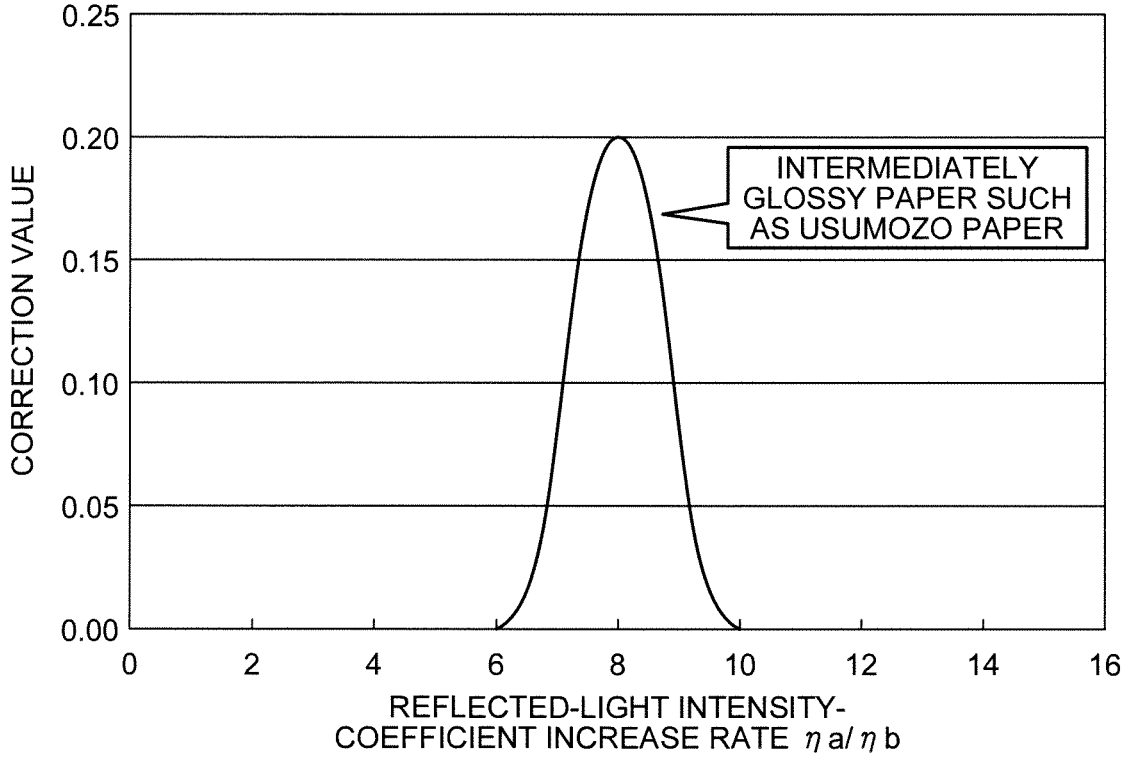
FIG. 10 is a diagram illustrating the relationship between the increase rate of the reflected light intensity coefficient and the correction value.

Described in more detail, the estimated value correcting section 74 performs correction of adding a correction value according to the increase rate ηa/ηb of the reflected light intensity coefficient to the static friction coefficient. FIG. 10 is a diagram illustrating the relationship between the increase rate ηa/ηb of the reflected light intensity coefficient and the correction value of the static friction coefficient. As illustrated in FIG. 10, the correction value is provided as a normal distribution curve. The average value of the normalized distribution curve is a value in the region of the increase rate ηa/ηb of the reflected light intensity coefficient that is represented by a sheet S having an intermediately glossy level such as an usumozo paper, and, for example, is a value about eight that is the increase rate ηa/ηb of the reflected light intensity coefficient, for example, represented by the usumozo paper. In addition, this normalized distribution curve represents that correction is not substantially performed for sheets S other than the sheets S having an intermediately glossy level. In other words, the normalized distribution curve is formed such that the correction value is zero or substantially zero in the region of the increase rates ηa/ηb of the reflected light intensity coefficient that are represented by sheets S such as the non-coated paper group or the glossy coated paper group other than the sheet having the intermediately glossy level. For example, correction values for a sheet S group having a low increase rate ηa/ηb (<6) and a sheet S group having a high increase rate ηa/ηb (>10) are zero or substantially zero.

Figure 11:
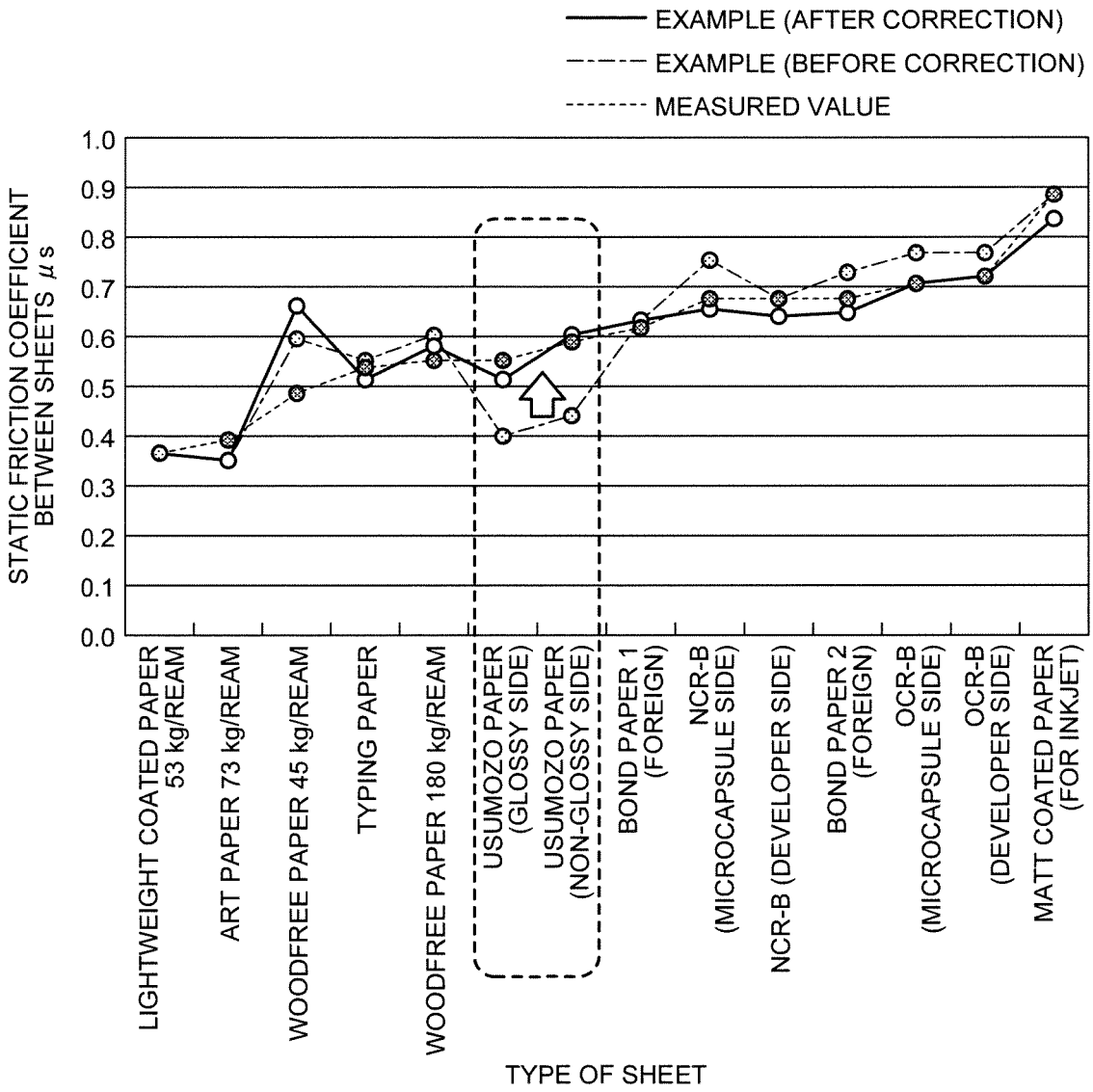
FIG. 11 is a diagram illustrating the measured value of the static friction coefficient and the estimated values thereof before and after correction.

By correcting the estimated value of the static friction coefficient as above, the accuracy of estimation of the static friction coefficient is improved. FIG. 11 is a diagram illustrating the measured value of the static friction coefficient and estimated values of the static friction coefficient before and after correction. In FIG. 11, an example (before correction) represents an estimated value of the static friction coefficient before correction is made by the estimated value correcting section 74, and an example (after correction) represents an estimated value of the static friction coefficient after correction is made by the estimated value correcting section 74. As illustrated in FIG. 11, by performing correction by using the estimated value correcting section 74, the accuracy of estimation of the static friction coefficient for the usumozo paper that is a sheet S having the intermediately glossy level is improved.

The separating force control section 75 optimizes the separating force of the separation mechanism 3 for the sheet S based on the estimated value of the static friction coefficient of the sheet S after correction.

Figure 12:
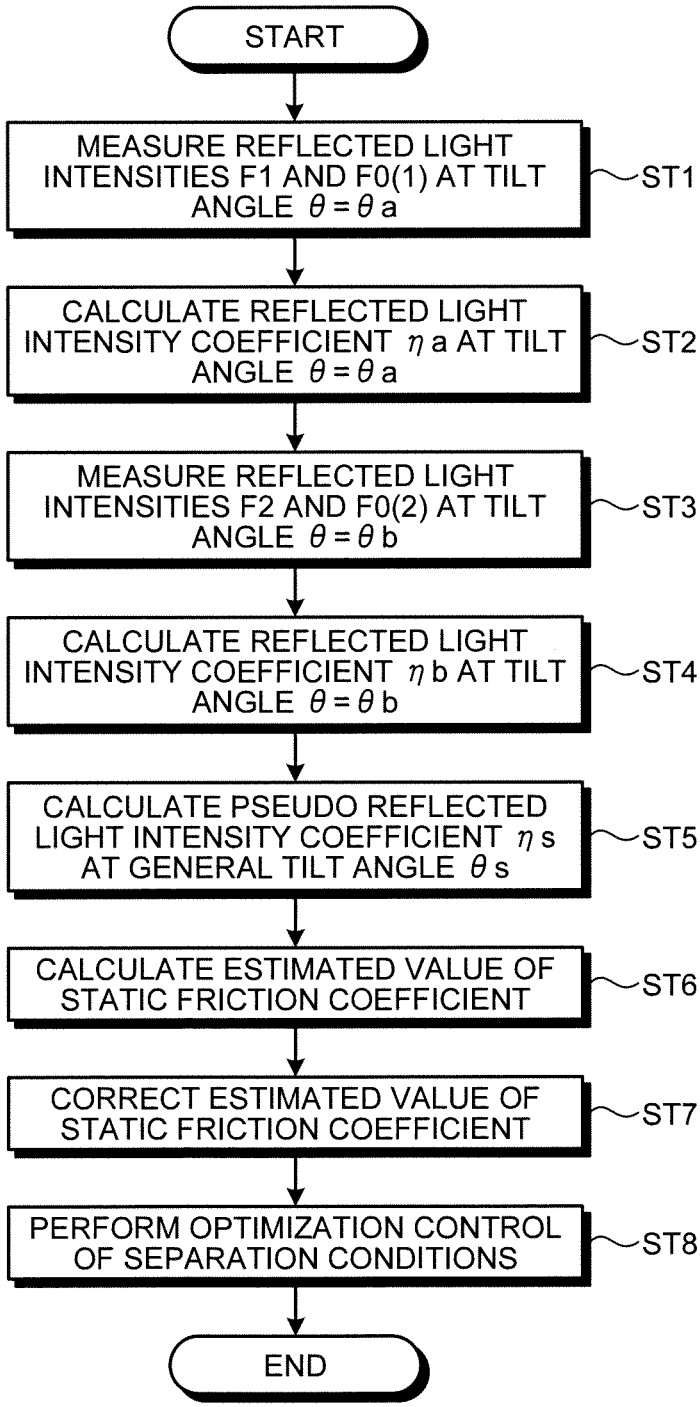
FIG. 12 is a flowchart illustrating the operation of controlling a separating force according to an embodiment.

Next, control of the separating force according to this embodiment will be described with reference to FIG. 12. FIG. 12 is a flowchart illustrating the operation of controlling the separating force according to this embodiment. This control flow, for example, is performed before starting to transport the first sheet S or until the following sheet S is started to be transported after the completion of the transport of the previous sheet S. Accordingly, the separating force used for separating the following sheet S can be controlled based on the result of detection of the reflected light intensity before the following sheet S is started to be separated and transported by the separation mechanism 3. However, the timing for detecting the reflected light intensity is not limited thereto. Although the detection of the reflected light intensity may be performed at another timing, it is preferable that the reflected light intensity is detected before the following sheet S is started to be separated by the separation mechanism 3.

First, in step ST1, the specularly-reflected light intensity F1 and the diffusely-reflected light intensity F0(1) at a tilt angle θ=θa are measured by the reflected light intensity coefficient calculating section 71. Here, the diffusely-reflected light intensity F0(1) represents the intensity of the reflected light of a diffusely-reflected light component that is received by the diffusely-reflected light receiving section 63 when light L1 emitted at a tilt angle θ=θa is emitted onto the sheet S. The reflected light intensity coefficient calculating section 71 allows the first specularly-reflected light receiving section 62*a* and the diffusely-reflected light receiving section 63 to detect the specularly-reflected light intensity F1 and the diffusely-reflected light intensity F0(1) in the state in which the first irradiation section 61*a* is allowed to emit the light L1, and the second irradiation section 61*b* is not allowed to emit light L2. The reflected light intensity coefficient calculating section 71 acquires the specularly-reflected light intensity F1 and the diffusely-reflected light intensity F0(1) based on output signals of the first specularly-reflected light receiving section 62*a* and the diffusely-reflected light receiving section 63.

Next, in step ST2, the first reflected light intensity coefficient ηa at a tilt angle θ=θa is calculated by the reflected light intensity coefficient calculating section 71. The reflected light intensity coefficient calculating section 71 calculates the first reflected light intensity coefficient ηa using the following Equation (1) based on the specularly-reflected light intensity F1 and the diffusely-reflected light intensity F0(1) that are acquired in step ST1.

$$\eta a = F0(1)/F1 \tag{1}$$

Next, in step ST3, the specularly-reflected light intensity F2 and the diffusely-reflected light intensity F0(2) at a tilt angle θ=θb are measured by the reflected light intensity coefficient calculating section 71. Here, the diffusely-reflected light intensity F0(2) represents the intensity of the reflected light of a diffusely-reflected light component that is received by the diffusely-reflected light receiving section 63 when the light L2 emitted at a tilt angle θ=θb is emitted onto the sheet S. The reflected light intensity coefficient calculating section 71 allows the second specularly-reflected light receiving section 62*b* and the diffusely-reflected light receiving section 63 to detect the specularly-reflected light intensity F2 and the diffusely-reflected light intensity F0(2) in the state in which the second irradiation section 61*b* is allowed to emit the light L2, and the first irradiation section 61*a* is not allowed to emit the light L1. The reflected light intensity coefficient calculating section 71 acquires the specularly-reflected light intensity F2 and the diffusely-reflected light intensity F0(2) based on output signals of the second specularly-reflected light receiving section 62*b* and the diffusely-reflected light receiving section 63.

Next, in step ST4, the second reflected light intensity coefficient ηb at a tilt angle θ=θb is calculated by the reflected light intensity coefficient calculating section 71. The reflected light intensity coefficient calculating section 71 calculates the second reflected light intensity coefficient ηb using the following Equation (2) based on the specularly-reflected light intensity F2 and the diffusely-reflected light intensity F0(2) that are acquired in step ST3.

$$\eta b = F0(2)/F2 \tag{2}$$

Next, in step ST5, the pseudo reflected light intensity coefficient ηs is calculated by the pseudo reflected light intensity coefficient calculating section 72. The pseudo reflected light intensity coefficient calculating section 72 calculates the pseudo reflected light intensity coefficient ηs based on the first reflected light intensity coefficient ηa calculated in step ST2 and the second reflected light intensity coefficient ηb calculated in step ST4. The pseudo reflected light intensity coefficient calculating section 72 calculates the pseudo reflected light intensity coefficient ηs using the following Equation (3), for example, in a case where the tilt angle θa=50 degrees, the tilt angle θb=75 degrees, and the predetermined tilt angle θs=67 degrees.

$$\eta s = (\eta a + 2\eta b)/3 \tag{3}$$

Next, in step ST6, an estimated value of the static friction coefficient is calculated by the friction coefficient estimating section 73. The friction coefficient estimating section 73 estimates the static friction coefficient of the sheet S that is to be separated next by the separation mechanism 3 based on the pseudo reflected light intensity coefficient ηs calculated in step ST5. The control unit 7 stores in advance a map corresponding to the correlation curve illustrated in FIG. 7, that is, a map representing the correspondence relationship between the reflected light intensity coefficient η and the static friction coefficient μs between sheets S that is acquired based on the measured value of the reflected light intensity coefficient η and the measured value of the static friction coefficient μs between sheets S when an irradiation beam with a tilt angle θs=67 degrees is emitted. The friction coefficient estimating section 73 calculates an estimated value of the static friction coefficient based on the map and the pseudo reflected light intensity coefficient ηs.

Next, in step ST7, the estimated value of the static friction coefficient is corrected by the estimated value correcting section 74. FIG. 13 is a diagram illustrating control of the separating force according to this embodiment. In FIG. 13, the first reflected light intensity coefficient ηa, the second reflected light intensity coefficient ηb, the increase rate ηa/ηb of the reflected light intensity coefficient, the degree of correction for an intermediately glossy level (or intermediate gloss level correction), and the level of the separating force (or separation force level) are illustrated for each type of the sheet S. As a sheet S is located on the higher level, the static friction coefficient between sheets S decreases. In each field, not a value but a level is displayed. For example, in the field of the first reflected light intensity coefficient ηa, five levels (A1, A2, A3, A4, and A5) from A1 having the smallest value to A5 having the largest value are represented. Similarly, in the field of the second reflected light intensity coefficient ηb, five levels from B1 that is the minimum level to B5 that is the maximum level are represented. In addition, in the field of the increase rate ηa/ηb of the reflected light intensity coefficient, five levels from E1 that is the minimum level to E5 that is the maximum level are represented.

As a basic consideration for a separating force control operation of controlling the separating force, it is difficult to separate a sheet S having a low specularly-reflected light intensity (gloss), and thus control of increasing the separating force is performed. In FIG. 13, a carbon-less paper or a matt-type inkjet paper corresponds to the sheet S having a low specularly-reflected light intensity. On the other hand, a sheet S having a high specularly-reflected light intensity and relatively low reflected light intensity coefficients ηa and ηb can be easily separated, and thus the separating force for such a sheet can be set to be relatively low. In FIG. 13, a gloss-type coated paper corresponds to the sheet S having a high specularly-reflected light intensity.

It is difficult to separate an usumozo paper S having an intermediately glossy level (or intermediate gloss) more than estimated based on the characteristics of the reflected light intensity. When the usumozo paper S is compared with a woodfree paper based on the first reflected light intensity coefficient ηa or the second reflected light intensity coefficient ηb, the usumozo paper has a lower level than the woodfree paper. However, the usumozo paper has a higher static friction coefficient between sheets S than the woodfree paper. As above, it is difficult to separate a sheet having the intermediately glossy level more than estimated based on the characteristics of the reflected light intensity, which is a peculiar tendency of the sheet S having the intermediately glossy level, and corresponding correction is necessary. Accordingly, as described with reference to FIG. 10, a distribution curve of a correction value is set in advance such that a high degree of correction is selectively performed for a sheet S having the intermediately glossy level such as an usumozo paper.

The estimated value correcting section 74 adds a correction value δ on the basis of the distribution curve to the estimated value of the static friction coefficient calculated in step ST6. As a result, the degree of correction for a sheet having the intermediately glossy level such as an usumozo paper is high, and the degree of correction for sheets S of other types is low. By correcting the static friction coefficient of a sheet S having the intermediately glossy level to a value that is larger than the static friction coefficient estimated based on the reflected light intensity coefficient η, as described with reference to FIG. 11, the estimated value of the static friction coefficient becomes close to the actual static friction coefficient of the sheet S. Accordingly, the separating force for the sheet S having the intermediately glossy level can be more appropriately set.

Next, in step ST8, optimization control of the separating force of the separation mechanism 3 for the sheet S is performed by the separating force control section 75. As the separating force control section 75 controls the driving of the separation mechanism 3 based on the estimated value of the static friction coefficient that has been corrected in step ST7, the separating force of the separation mechanism 3 for the sheet S is optimized. In this embodiment, the pressing force for the separation pad 321 that is generated by the pressing force control section 322 is controlled as the separating force. The pressing force of the pressing force control section 322 is divided into five levels, and the pressing force is increased in the order of level 1, level 2, level 3, level 4, and level 5.

As illustrated in FIG. 13, for a sheet having the characteristics of the reflected light intensity corresponding to the gloss-type coated paper, the separating force is determined as level 2, and the pressing force of the pressing force control section 322 is set as lower than the pressing force for any other sheet S represented in FIG. 13. Here, the characteristics of the reflected light intensity, for example, are characteristics that include the relationship between the tilt angle θ of emitted light and the reflected light intensity or the reflected light intensity coefficient, the degree of change in the reflected light intensity or the reflected light intensity coefficient with respect to the change in the tilt angle θ of light, and the like. For a sheet S having the characteristics of the reflected light intensity corresponding to those of a woodfree paper, the separating force is set to level 3. For a sheet S having the characteristics of the reflected light intensity corresponding to those of a sheet having the intermediately glossy level such as an usumozo paper, the separating force is set to level 4, and thus the pressing force of the pressing force control section 322 is set to be higher than that for the woodfree paper. In addition, for a sheet S having the characteristics of the reflected light intensity corresponding to those of a carbon-less paper or a matt-type inkjet paper, the separating force is set to level 5 that is the maximum level.

As above, according to the medium supplying apparatus 1 of this embodiment, the separating force of the separation mechanism 3 for the sheet S can be set in accordance with the static coefficient of the sheet S as a separation target. The level of the separating force is determined in accordance with the estimated value of the estimated value of the static friction coefficient of the sheet, and the pressing force of the separation pad 321 for the sheet S can be adjusted to an appropriate pressing force. Accordingly, the separation between the separation target sheet S and the transport target sheet S is appropriately performed, and the feed of multiple sheets S is suppressed, whereby the separation capability or the stability is markedly performed.

In addition, in the medium supplying apparatus 1, the measurement unit 6 is arranged on the upstream side of the separation mechanism 3 in the transport direction of the sheet, and the reflected light intensity is measured for the sheet S to be separated and transported next. Accordingly, the reflected light intensity is measured for each sheet S that is sequentially transported, and the separating force for the sheet S is optimized. Therefore, the sheet S is appropriately separated and transported, and there is an advantage in that the feed of multiple sheets S is prevented.

In addition, the static friction coefficient of the sheet S is estimated based on the reflected light intensity coefficient $\eta$ that is the ratio of the diffusely-reflected light intensity to the specularly-reflected light intensity. Since the reflected light intensity coefficient $\eta$ is not influenced by the light intensities of the irradiation sections 61*a* and 61*b*, an error in the measured value due to variations (dispersion or time-dependent change) between the irradiation sections 61*a* and 61*b* and the change in time is reduced. Therefore, there is an advantage in that the accuracy of the estimated value of the static friction coefficient of the sheet S is improved.

The measurement unit 6 and the control unit 7 can estimate the static friction coefficient in a non-contact manner based on the reflected light intensity, and accordingly, the static friction coefficient can be detected without damaging the sheet S. In addition, although it is very difficult to directly measure the static friction coefficient of the sheet placed on the tray 2 through a contact or the like in advance, the static friction coefficient can be immediately estimated by the measurement unit 6 with high accuracy in an indirect manner.

In the medium supplying apparatus 1 according to this embodiment, in a plurality of irradiation beams having different incidence angles with respect to the surface of the sheet, pairs of an irradiation section that emits an irradiation beam and a specularly-reflected light receiving section that receives a specularly-reflected light component of the reflected light for the irradiation beam and detects the intensity of the specularly-reflected light are included. The first pair is a pair of the first irradiation section 61*a* and the first specularly-reflected light receiving section 62*a* and the second pair is a pair of the second irradiation section 61*b* and the second specularly-reflected light receiving section 62*b*. Then, the separating force is controlled based on the ratio of the diffusely-reflected light intensity at the time of emission of the irradiation beam to the specularly-reflected light intensity detected by the specularly-reflected light receiving section corresponding to the irradiation beam for each irradiation beam. As above, by acquiring detection results of a plurality of combinations of the irradiation sections having different incidence angles and the specularly-reflected light receiving sections, the accuracy of estimation of the static friction coefficient between sheets S is improved, and the separating force can be optimally controlled.

The medium supplying apparatus 1 according to this embodiment includes the first irradiation section 61*a* and the second irradiation section 61*b* that have different title angles $\theta$, and the pseudo reflected light intensity coefficient $\eta s$ in the case of emission of light with an intermediate tilt angle is calculated based on the first reflected light intensity coefficient $\eta a$ at the time of light emission of the first irradiation section 61*a* and the second reflected light intensity coefficient $\eta b$ at the time of light emission of the second irradiation section 61*b*. Accordingly the degree of freedom of arrangement of the irradiation sections 61*a* and 61*b* and the specularly-reflected light receiving sections 62*a* and 62*b* is improved, and the medium supplying apparatus is useful for mounting the sensors and for miniaturization of the measurement unit 6.

In this embodiment, although the pressing force used for pressing the separation pad 321 toward the pick roller 31 is controlled as the separating force for the sheet, the separating force is not limited thereto. In addition to the pressing force or instead of the pressing force, the friction force or the friction coefficient of the separation pad 321 may be controlled.

In addition, in this embodiment, although the tilt angle of the first irradiation section 61*a* is set $\theta a=50$ degrees and the tilt angle of the second irradiation section 61*b* is set $\theta b=75$ degrees, the tilt angles are not limited thereto. In addition, the predetermined tilt angle $\theta s$ is not limited to 67 degrees. Furthermore, although the tilt angle of the diffusely-reflected light receiving section 63 is set to zero degrees, the tilt angle is not limited thereto. Each tilt angle can be appropriately set. For example, the tilt angle $\theta a$ of the first irradiation section 61*a* and the tilt angle $\theta b$ of the second irradiation section 61*b* may be set to arbitrary angles different from each other in the range greater than zero degrees and smaller than 90 degrees.

In this embodiment, although the measurement unit 6 detects the reflected light intensity of the sheets S stacked in the tray 2, the arrangement of the measurement unit 6 is not limited thereto. For example, the measurement unit 6 may be arranged in a transport path of the sheet S so as to detect the reflected light intensity of the transported sheet S. In a apparatus in which normally sheets S of one type are stacked in the tray 2, even in a case where the separating force used for separating the following sheet S is controlled based on the characteristics of the reflected light intensity of the sheet S transported in advance, an advantage of suppressing the feed of multiple sheets S can be acquired.

Second Embodiment

Figure 17:
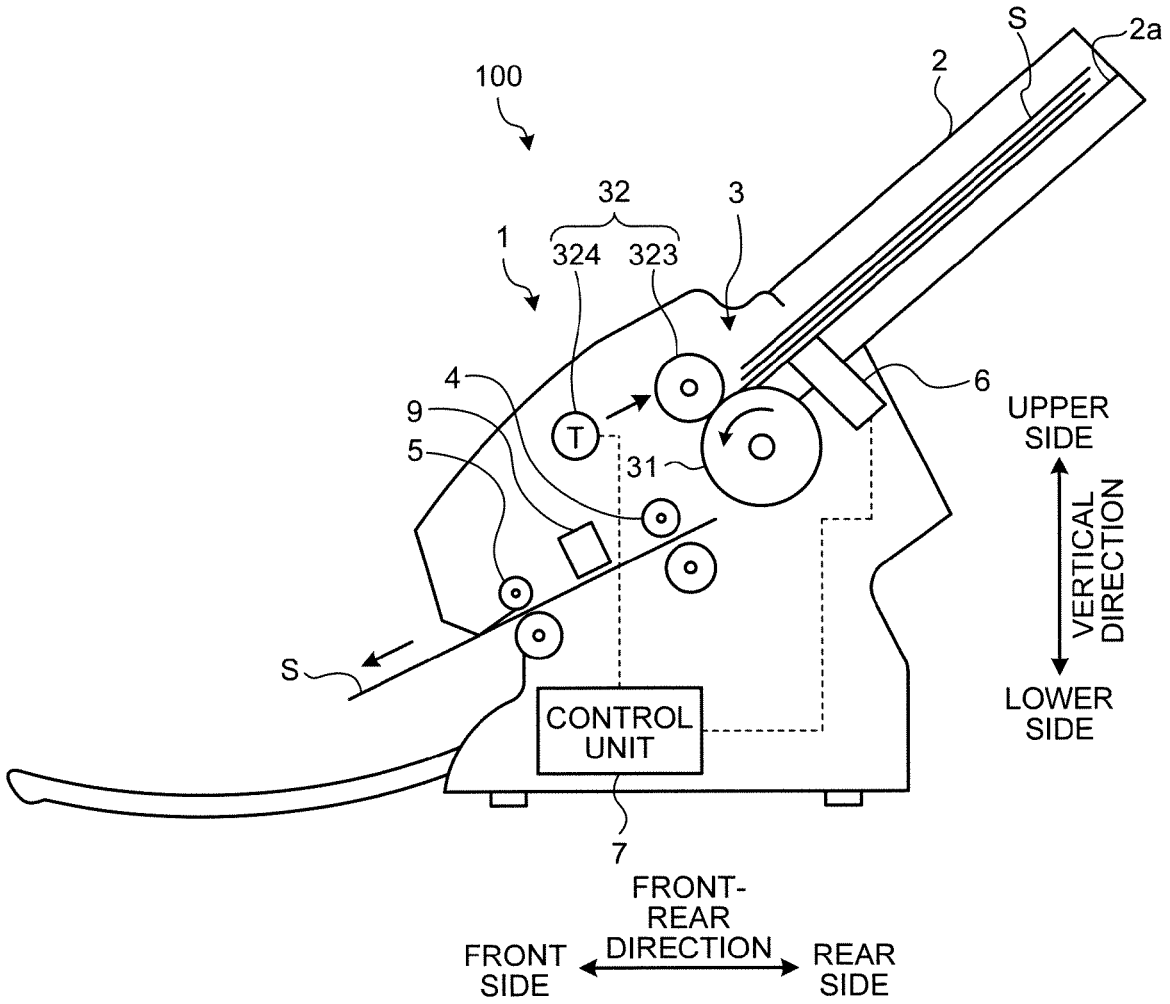
FIG. 17 is a cross-sectional view of an image scanner including a medium supplying apparatus according to a second embodiment.

A second embodiment will be described with reference to FIG. 17. In the second embodiment, the same reference numeral is assigned to a constituent element having the same function as that described in the above-described embodiment, and redundant description thereof will be omitted. FIG. 17 is a cross-sectional view of an image scanner including a medium supplying apparatus according to the second embodiment.

A separation mechanism 3 according to this embodiment includes a brake roller 323 and a torque control section 324 instead of the separation pad 321 and the pressing force control section 322 of the first embodiment. The brake roller 323 applies a force in a direction opposite to the transport direction for a sheet S interposed between the brake roller 323 and the pick roller 31. The brake roller 323 is formed of a material having a high frictional force, for example, foamed rubber in a cylindrical shape. The brake roller 323 is arranged on a side opposite to the pick roller 31 side with an extended plane of the loading face 2*a* interposed therebetween and faces the outer circumferential face of the pick roller 31 in the direction of the normal line of the loading face 2*a*.

The brake roller 323 has a torque limiter not shown in the figure and rotates in accordance with the rotational torque in a case where a predetermined level or a higher level of the rotational torque is applied. When a sheet S is interposed between the brake roller 323 and the pick roller 31, a transport force that is, rotational torque is applied from the pick roller 31 to the brake roller 323 through the sheet S. At this time, in a case where a plurality of sheets S is interposed between the brake roller 323 and the pick roller 31 in an overlapping state, the rotational torque applied to the brake roller 323 differs depending on the friction coefficient between the sheets S. When the transferred torque is below the limit torque of the brake roller 323, the brake roller 323 stops rotating, and a separation target sheet S that is brought into contact with the brake roller 323 is separated from a transport target sheet S.

The limit torque of the brake roller 323 can be changed and is controlled by the torque control section 324. The torque control section 324 controls the limit torque of the brake roller 323 based on an estimated value of the static friction coefficient between sheets S. Described in more detail, the torque control section 324 sets the limit torque to higher torque as the level number of the separating force is greater. On the other hand, the torque control section 324 sets the limit torque to lower torque as the level number of the separating force is smaller. Accordingly, the limit torque is set in accordance with the difficulty in separating the sheet S to be separated next, and the separating force of the separation mechanism 3 for the sheet S is appropriate.

As above, in this embodiment, the torque control section 324 adjusts the separation capability of the sheet S by controlling the limit torque of the brake roller 323, that is, a transport load trying to stop the sheet S. As the sheet S is separated and transported with an appropriate separating force according to the static friction coefficient of the sheet, the occurrence of the feed of multiple sheets S is suppressed.

In addition, as the separation unit 32 that changes the separating force, other than the brake roller 323 and the torque control section 324, known types such as a reverse roller type, a reverse belt type, a retard roller type, or a gate roller type can be applied.

First Modification of Each Embodiment

A first modification of each of the above-described embodiments will be described. In each of the above-described embodiments, an estimated value of the static friction coefficient between sheets S is calculated, and the separating force is determined based on the estimated value. However, the invention is not limited thereto. Thus, the separating force of the separation mechanism 3 may be determined without estimating the static friction coefficient between sheets S. For example, in a case where the separating force is determined based on a map in which the correspondence relationship among the pseudo reflected light intensity coefficient $\eta s$, the increase rate $\eta a/\eta b$ of the reflected light intensity coefficient, and the separating force is determined, the separating force can be controlled without estimating the static friction coefficient.

In addition, the separating force may be determined in accordance with an estimated type of a sheet S by estimating the type of the sheet S that is to be separated next based on a map in which the correspondence relationship among the pseudo reflected light intensity coefficient $\eta s$, the increase rate $\eta a/\eta b$ of the reflected light intensity coefficient, and the type of a sheet S is determined.

Second Modification of Each Embodiment

A second modification of each of the above-described embodiments will be described. In each of the above-described embodiments, although the separating force used for separating the sheet S is controlled based on the two reflected light intensity coefficients $\eta a$ and $\eta b$ corresponding to light irradiated at different tilt angles $\theta$, however, the invention is not limited thereto. It may be configured that only one irradiation unit is arranged, and the separating force is controlled based on one reflected light intensity coefficient $\eta$. Even in such a case, the separating force can be controlled in accordance with the difficulty in separating the sheet, and the feed of multiple sheets S can be suppressed.

In addition, the medium supplying apparatus 1 may include three or more irradiation sections that emit light at different tilt angles $\theta$ and specularly-reflected light receiving sections corresponding to the irradiation sections. By detecting three or more reflected light intensity coefficients, the accuracy of the estimation of the static friction coefficient of the sheet S can be improved.

Third Modification of Each Embodiment

A third modification of each of the above-described embodiments will be described. In each of the above-described embodiments, although the first irradiation section 61*a* and the second irradiation section 61*b* are independent light sources, the invention is not limited thereto. For example, light may be emitted onto the sheet S at different tilt angles $\theta$ by moving one light source. Similarly, the first specularly-reflected light receiving section 62*a* and the second specularly-reflected light receiving section 62*b* may not be independent light receiving sections. Thus, specularly-reflected light components of light emitted at different tilt angles $\theta$ may be received by one light receiving section by moving the one light receiving section.

Fourth Modification of Each Embodiment

A fourth modification of each of the above-described embodiments will be described. In each of the above-described embodiments, although the separating force used for separating the sheet S is controlled based on both the specularly-reflected light component and the diffusely-reflected light component of reflected light that is emitted from the irradiation section and is reflected from the sheet, the separating force may be controlled based on the reflected light intensity of any one of the reflected light components. For example, the separating force may be controlled based on only the reflected light intensity of the specularly-reflected light component.

Fifth Modification of Each Embodiment

A fifth modification of each of the above-described embodiments will be described. In each of the above-described embodiments, although the correction value for the estimated value of the static friction coefficient is determined based on the increase rate $\eta a/\eta b$ of the reflected light intensity coefficient, the invention is not limited thereto. Thus, the correction value for the estimated value of the static friction coefficient may be determined based on the change ratio F2/F1 of the specularly-reflected light intensity, the change ratio F0(2)/F0(1) of the diffusely-reflected light intensity, or the like instead of the increase rate $\eta a/\eta b$ of the reflected light intensity coefficient.

Sixth Modification of Each Embodiment

A sixth modification of each of the above-described embodiments will be described. In each of the above-described embodiments, the measurement unit 6 may also serve as an emptiness sensor that detects the presence of a sheet S loaded in the tray 2.

A medium supplying apparatus according to the embodiments includes: an irradiation unit that emits light onto the surface of a medium; and a light receiving unit that receives reflected light that is acquired by allowing the light emitted by the irradiation unit to be reflected from the surface of the medium and detects a reflected light intensity, in which a separating force of a separation mechanism that is used for separating the following medium is controlled based on the reflected light intensity detected by the light receiving unit. Therefore, the medium supplying apparatus according to the embodiments is advantageous in that the separating force used for separating one medium from a stacked media group can be appropriately set.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A medium supplying apparatus comprising:

a loading rack having a plurality of sheet-shaped media stacked therein;

a separation mechanism that separates one medium at a time from the plurality of media and transports the medium;

an irradiation unit that emits light onto a surface of the medium which is to be separated, the irradiation unit including:

a first irradiation section that emits a first irradiation beam onto the surface of the medium at a first incidence angle; and a second irradiation section that emits a second irradiation beam onto the surface of the medium at a second incidence angle, which is different from the first incidence angle, the first irradiation beam and the second irradiation beam being selectively emitted;

a light receiving unit that receives the reflected light reflected from the surface of the medium, the light emitted by the irradiation unit, and detects an intensity of the reflected light, the light receiving unit including:

a first specularly-reflected light receiving section that receives the specularly-reflected light component of the reflected light at the time of emission of the first irradiation beam and detects an intensity of the specularly-reflected light;

a second specularly-reflected light receiving section that receives the specularly-reflected light component of the reflected light at the time of emission of the second irradiation beam and detects an intensity of the specularly-reflected light; and a diffusely-reflected light receiving unit that receives a diffusely-reflected light component of the reflected light and detects an intensity of the diffusely-reflected light component; and a controller connected to the separation mechanism, the irradiation unit, and the light receiving unit, wherein based on a ratio of the diffusely-reflected light intensity at the time of emission of the first irradiation beam to the specularly-reflected light intensity detected by the first specularly-reflected light receiving section and a ratio of the diffusely-reflected light intensity at the time of emission of the second irradiation beam to the specularly-reflected light intensity detected by the second specularly-reflected light receiving section, the controller controls the separation mechanism to set a separating force for separating a next medium.

2. The medium supplying apparatus according to claim 1, wherein the separating force is controlled based on a ratio of a second reflected light intensity coefficient that is a ratio of the diffusely-reflected light intensity at the time of emission of the second irradiation beam to the specularly-reflected light intensity detected by the second specularly-reflected light receiving section to a first reflected light intensity coefficient that is a ratio of the diffusely-reflected light intensity at the time of emission of the first irradiation beam to the specularly-reflected light intensity detected by the first specularly-reflected light receiving section.

3. The medium supplying apparatus according to claim 1, wherein, for a plurality of irradiation beams having different incidence angles with respect to the surface of the medium, included are pairs of the irradiation unit that emits the irradiation beam and the specularly-reflected light receiving unit that receives the specularly-reflected light component of the reflected light at the time of emission of the irradiation beam and detects the specularly-reflected light intensity, and wherein the separating force is controlled based on a ratio of the diffusely-reflected light intensity at the time of emission of the irradiation beam to the specularly-reflected light intensity detected by the specularly-reflected light receiving unit corresponding to the irradiation beam for each of the irradiation beams.

4. The medium supplying apparatus according to claim 1, wherein the separation mechanism includes:

a pick roller that rotates in a state of being in contact with a transport target medium that is the medium, which is to be separated next by the separation mechanism, out of the plurality of stacked media, to discharge the transport target medium;

a separation member that is brought into contact with another medium that is to be potentially discharged along with the transport target medium in an overlapping state, to separate the transport target medium from the another medium; and a driving unit for driving the pick roller.

5. The medium supplying apparatus according to claim 1, wherein the separating force includes at least one of a transport load of the separation member and a pressing force used for pressing the separation member toward the another medium.

6. The medium supplying apparatus according to claim 4, wherein the separation member includes a separation pad that suppresses the movement of the medium in a transport direction by making contact with the medium, and a pressing force control section that presses the separation pad toward an outer circumferential face of the pick roller.

7. The medium supplying apparatus according to claim 6, wherein the pressing force control section includes a spring.

8. The medium supplying apparatus according to claim 6, the pressing force control section is controlled by the controller to set the separating force.

9. The medium supplying apparatus according to claim 1, further comprising:

a half-cylinder having a plane portion and an arc portion, wherein the arc portion includes the first irradiation section, the second irradiation section, the first specularly-reflected light receiving section, the second specularly-reflected light receiving section, and the diffusely-reflected light receiving unit, such that the irradiation sections, the specularly-reflected light receiving sections and the diffusely-reflected light receiving unit are disposed at the same position in an axial direction of the half-cylinder.

10. The medium supplying apparatus according to claim 9, wherein the half-cylinder is fixed to the loading rack and the plane portion of the half-cylinder is located on the same plane as that of the loading rack.

* * * * *